US010688381B2

(12) United States Patent
Shindo et al.

(10) Patent No.: US 10,688,381 B2
(45) Date of Patent: Jun. 23, 2020

(54) GAME BOARD

(71) Applicant: EPOCH COMPANY, LTD., Tokyo (JP)

(72) Inventors: Yukihiro Shindo, Tokyo (JP); Shigekazu Hoshino, Saitama (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 16/148,045

(22) Filed: Oct. 1, 2018

(65) Prior Publication Data

US 2019/0099663 A1 Apr. 4, 2019

(30) Foreign Application Priority Data

Oct. 3, 2017 (JP) ..... 2017-193710

(51) Int. Cl.
*A63F 7/06* (2006.01)
*A63F 7/30* (2006.01)

(52) U.S. Cl.
CPC ..... *A63F 7/0676* (2013.01); *A63F 7/0616* (2013.01); *A63F 7/30* (2013.01)

(58) Field of Classification Search
CPC ..... A63F 7/0676; A63F 7/0616; A63F 7/30
USPC ..... 273/108, 108.1, 108.2, 108.21, 108.31, 273/108.4, 441; 473/4, 29, 138
See application file for complete search history.

(56) References Cited

U.S. PATENT DOCUMENTS 1,911,651 A * 5/1933 Snodgrass ..... A63F 7/0608 273/108.31
2,207,190 A * 7/1940 Carnahan ..... A63F 9/00 273/108
3,554,547 A * 1/1971 Vedeen ..... A63F 7/0684 273/108.51
3,856,303 A 12/1974 Payne, Jr. et al.
(Continued)

FOREIGN PATENT DOCUMENTS

CN 204411679 U 6/2015
CN 209316992 U 8/2019
(Continued)

OTHER PUBLICATIONS

Extended European Search Report dated Feb. 18, 2019 that issued in 18198222.4.
(Continued)

*Primary Examiner* — Vishu K Mendiratta
(74) *Attorney, Agent, or Firm* — Faegre Drinker Biddle & Reath LLP

(57) ABSTRACT

A game board includes: a field plate; a rod-shaped manipulation lever disposed under the field plate; and a player figure which is disposed above the field plate and make a play on a ball located on the field plate. The field plate has a long through-hole. The player figure is attached to the manipulation lever through the through-hole. The player figure is movable above the field plate as the manipulation lever is moved in its axial direction, and is rotatable about a pivot portion of the player figure by a rotation manipulation on the manipulation lever. The field plate has, beside the through-hole, a ball holding portion to allow the ball to stay. Part of the player figure is capable of coming into contact with the ball staying in the ball holding portion.

5 Claims, 17 Drawing Sheets

(56) References Cited

U.S. PATENT DOCUMENTS

| | | | | | |
|---|---|---|---|---|---|
| 4,042,239 | A * | 8/1977 | Cecchetti | A63F 7/0684 | 273/108.52 |
| 4,076,242 | A * | 2/1978 | Joseph | A63F 7/0684 | 273/108.51 |
| 4,967,434 | A * | 11/1990 | Hill | A47C 21/022 | 24/72.5 |
| 4,976,434 | A | 12/1990 | Wikner | | |
| 5,655,767 | A * | 8/1997 | Francis | A63F 7/0684 | 273/108.1 |
| 6,409,169 | B1 * | 6/2002 | Sutter | A63F 7/06 | 273/108.1 |
| 6,659,457 | B1 * | 12/2003 | Cheng | A63F 7/06 | 273/108.1 |
| 2002/0140167 | A1 * | 10/2002 | Bialler | A63F 7/0684 | 273/108.56 |
| 2005/0035541 | A1 * | 2/2005 | Oister | A63F 7/06 | 273/108.1 |
| 2019/0099663 | A1 | 4/2019 | Shindo et al. | | |

FOREIGN PATENT DOCUMENTS

| | | | |
|---|---|---|---|
| JP | 2015-136427 | A | 7/2015 |
| JP | UM-U-3209027 | | 2/2017 |
| SU | 1266554 | A1 | 10/1986 |

OTHER PUBLICATIONS

Office Action dated Apr. 19, 2019 in Russian Patent Application No. 2018134462 (7 pages) with an English Translation (8 pages).

The First Office Action dated Oct. 8, 2019 in Chinese Patent Application No. 201811167945.7 (7 pages) with an English translation (7 pages).

* cited by examiner

GAME BOARD

CROSS-REFERENCES TO RELATED APPLICATIONS

This application is based on and claims priority from Japanese Patent Application No. 2017-193710 filed on Oct. 3, 2017, the entire contents of which are incorporated herein by reference.

FIELD

The present invention relates to a game board for a game that simulates a sport game.

BACKGROUND

Table-type soccer game machines are known in which a field is formed on the top surface of a rectangular table whose shorter sides measure about 1 m, for example, and two goals are set and player figures of two teams such as goal keepers, forward players, and defenders are arranged in the field so as to be able to be manipulated.

Home soccer game boards are also known which are a miniaturized version of table-type soccer game machines and which assume a box shape having a certain thickness and a rectangular horizontal shape measuring several tens of centimeters in each of two orthogonal directions and have an appearance like a soccer-specific stadium (refer to JP-A-2015-136427, for example).

SUMMARY

In the game board disclosed in JP-A-2015-136427, a top plate that simulates a soccer field is formed with an even number of straight movement grooves parallel with the longer sides of the top plate and players that are attached to manipulation levers can be moved along the straight movement grooves. In game boards having such a configuration, during a game a ball tends to roll along and stop on the straight movement grooves. In those cases, since the ball and the nearest player figure are located on the same straight movement groove, the ball can be moved only in a limited range of direction, that is, mainly in a lateral direction, by a user's manipulation of rotating the player figure.

The present invention has been made in view of the above-described problem, and an object thereof is to provide a game board capable of increasing the degree of freedom of the direction in which a ball can be moved.

One aspect of the present invention provides a game board including: a field plate; a rod-shaped manipulation lever disposed under the field plate; and a player figure which is disposed above the field plate and make a play on a ball located on the field plate, wherein the field plate has a long through-hole, wherein the player figure is attached to the manipulation lever through the through-hole, wherein the player figure is movable above the field plate as the manipulation lever is moved in its axial direction, and is rotatable about a pivot portion of the player figure by a rotation manipulation on the manipulation lever, wherein the field plate has, beside the through-hole, a ball holding portion to allow the ball to stay, and wherein part of the player figure is capable of coming into contact with the ball staying in the ball holding portion.

The above configuration can provide a game board capable of increasing the degree of freedom of the direction in which a ball can be moved.

BRIEF DESCRIPTION OF DRAWINGS

FIG. 11A shows a state that a slant surface of a pressing portion starts coming into contact with contact portion of the launching member, FIG. 11B shows a state that the contact portion of the launching member is going up across the slant surface of the pressing portion, and FIG. 11C shows a state that the contact portion of the launching member has just gone over the slant surface of the pressing portion.

FIG. 12C is a rear view of the player figure part of whose torso is seen through.

FIG. 14A shows the player figure that is advancing toward the opponent's goal, FIG. 14B shows a state that the player figure has been turned horizontally so that its back faces the opponent's goal, and FIG. 14C shows an instant that the player figure has just started an overhead bicycle shot.

DETAILED DESCRIPTION

A game board 100 according to an embodiment of the present invention will be hereinafter described in detail with reference to the drawings.

<Overall Configuration>

Figure 1:
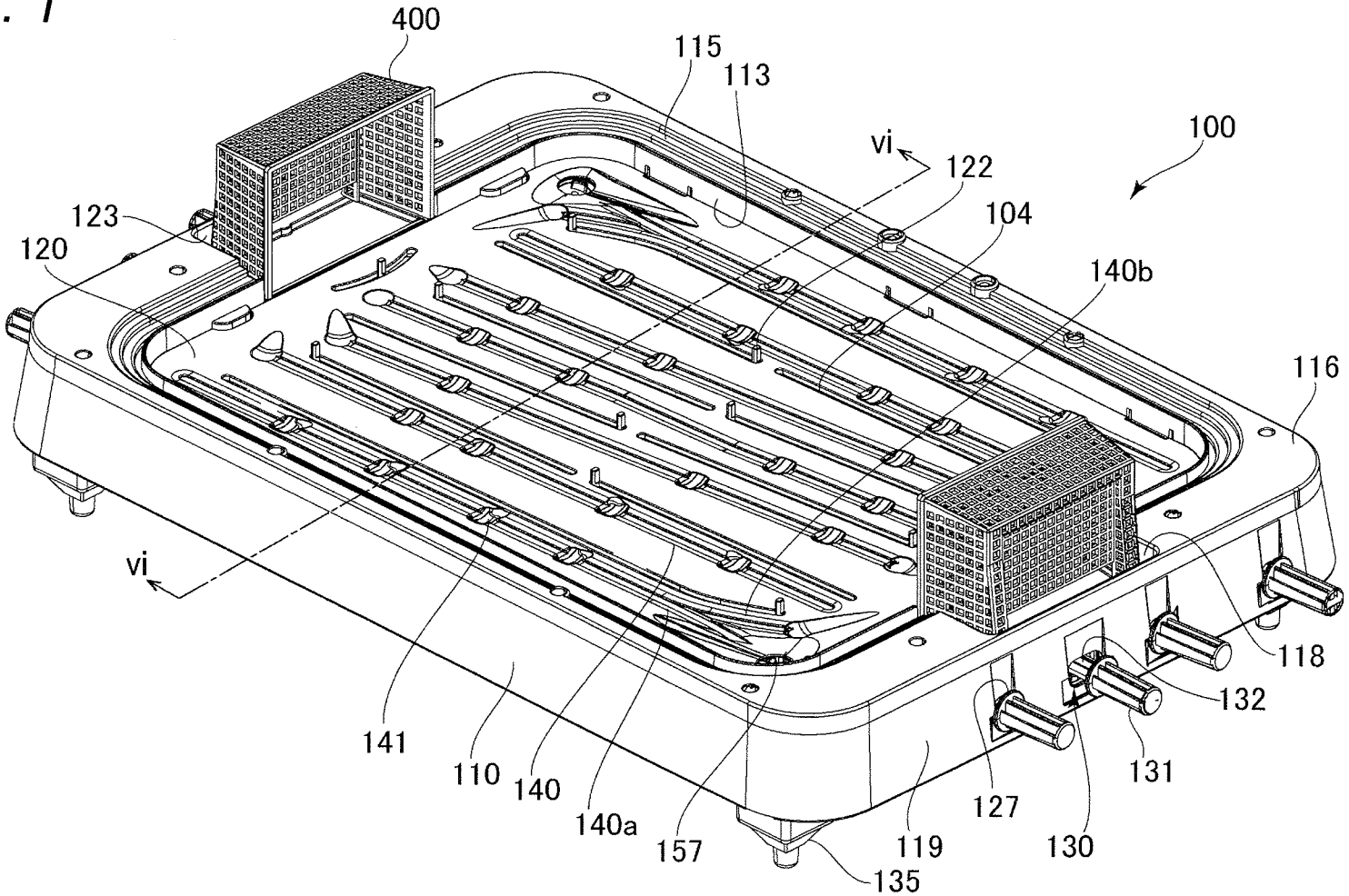
FIG. 1 is a perspective view of a game board according to an embodiment of the present invention.
Figure 2:
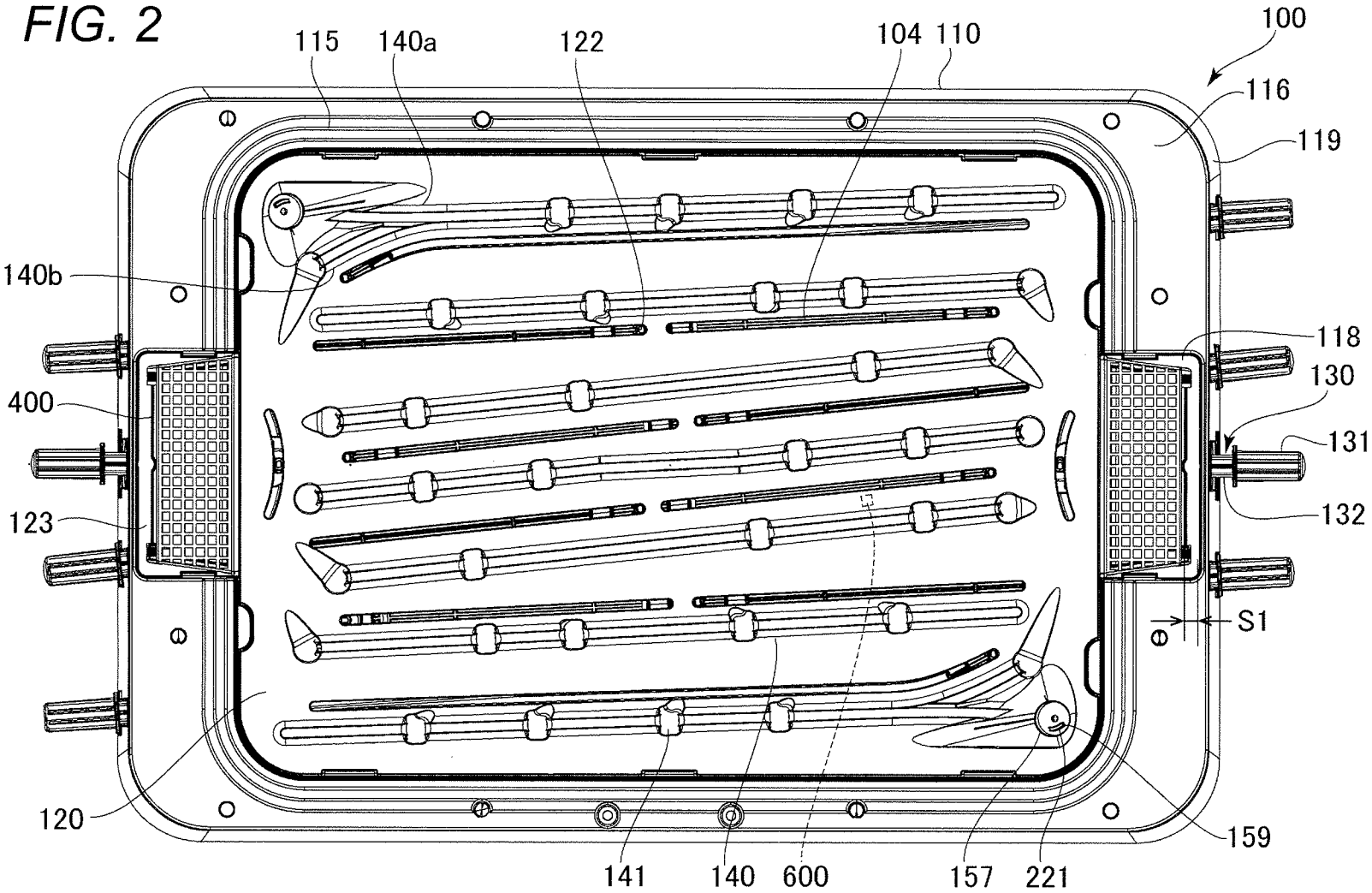
FIG. 2 is a plan view of the game board according to the embodiment.
Figure 3:
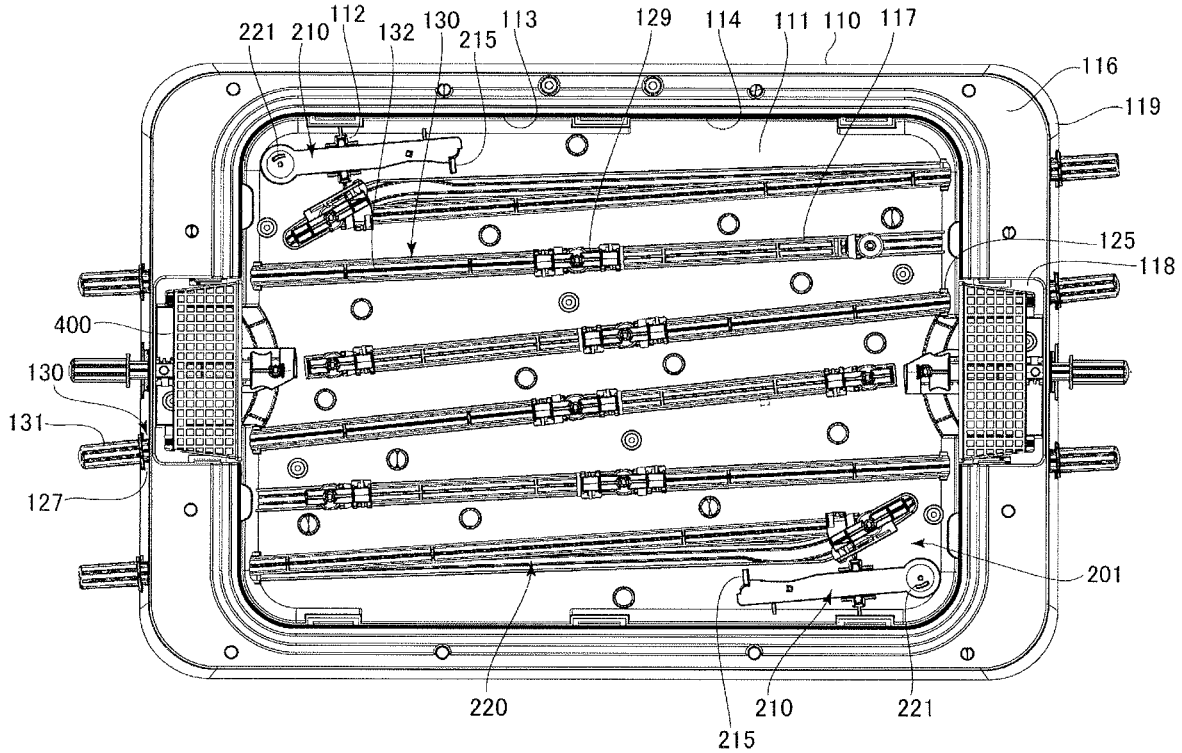
FIG. 3 is a plan view of the game board with a field plate removed.

FIG. 1 is a perspective view of the game board 100 according to the embodiment of the invention. FIG. 2 is a plan view of the game board 100 according to the embodiment. FIG. 3 is a plan view of the game board 100 with a field plate 120 removed. As shown in FIGS. 1-3, the game board 100 is equipped with a main body 110, the field plate 120, manipulation levers 130, and goal members 400.

The game board 100 has an appearance like a soccer-specific stadium because the main body 110 is provided with the field plate 120 which simulates a soccer field, the goal members 400, etc.

As shown in FIGS. 1-3, the main body 110 has a bottom plate 111 which is a generally rectangular flat plate and is rounded at the corners. The main body 110 has an inside circumferential wall 113 which is erected approximately vertically from the circumference of the bottom plate 111. The inside circumferential wall 113 is formed with a field plate receiving portion 114 provided at a top edge and having a horizontal surface for supporting the field plate 120. A stepped member 115 which simulates a stand is provided outside the field plate receiving portion 114. The main body 110 also has a horizontal rectangular-ring-shaped outer circumferential flange 116 which is a flat plate and extends outward from the top circumferential edge of the stepped member 115. The main body 110 further has a side wall 119 which extends downward from the outside edge of the outer circumferential flange 116.

The bottom plate 111 is formed with straight grooves 117 approximately parallel with the longer sides of the main body 110, and the straight grooves 117 serve to guide respective rod-shaped manipulation levers 130. Launching mechanisms 201 are provided in the vicinities of the two respective corners of the bottom plate 111.

The main body 110 is formed with, at the centers of its two shorter sides, recesses 118 in which the goal members 400 are set, respectively. The bottom surfaces of the recesses 118 are approximately the same in height as the field plate 120 which is placed on the field plate receiving portion 114.

The inside surface of the side wall 119 is provided with legs 135 at its four corners so that the game board 100 can be placed on a table or the like.

Each manipulation lever 130 has a rod-shaped portion 132, a grip portion 131, and a figure mounting stage(s) 129. The grip portion 131 is connected to the rear end of the rod-shaped portion 132. The figure mounting stage 129 is provided at the tip or a halfway position of the rod-shaped portion 132.

The manipulation lever 130 are disposed between the field plate 120 and the bottom plate 111 of the main body 110 (under the field plate 120) in a state that the field plate 120 is attached to the main body 110.

An even-number of manipulation levers 130 are provided at the shorter-side portions of the side wall 119. The side wall 119 and the inner circumferential wall 113 of the main body 110 are formed with outer wall long holes 127 and inner wall long holes 125, respectively, which are a little larger than the diameter of the circle of the manipulation lever 130 in cross section. Each manipulation lever 130 penetrates through the associated outer wall long hole 127 and inner wall long hole 125 and can be moved in its axial direction along the associated groove 117 of the bottom plate 111.

The grip portion 131 of each manipulation lever 130 sticks out from the side wall 119. Each manipulation lever 130 is so long that when the grip portion 131 is located closest to the side wall 119, the tip of the manipulation lever 130 is located in the vicinity of the shorter-side portion, located on the opposite side, of the inside circumferential wall 113.

Figure 4:
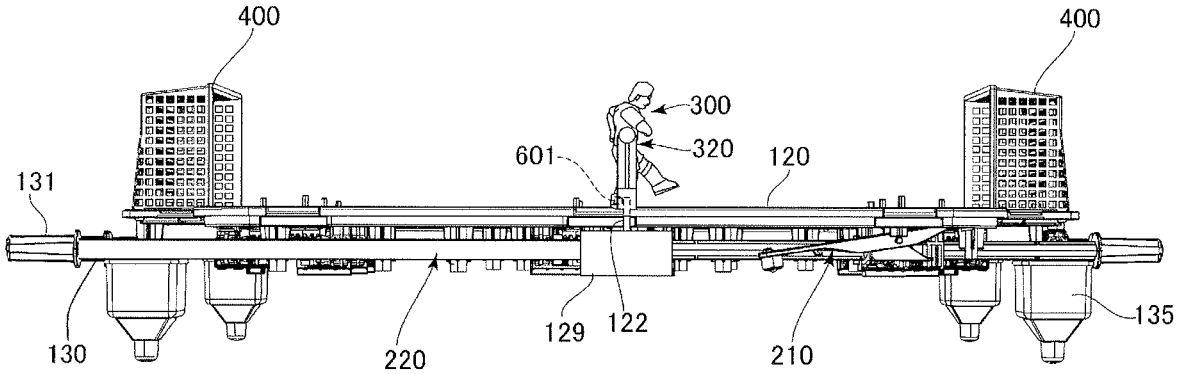
FIG. 4 is a side view of the game board with a main body removed.

FIG. 4 is a side view of the game board 100 with the main body 110 removed. As shown in FIG. 4, an erected pin 122 which is erected from the top surface of the (or each) figure mounting stage 129 of each manipulation lever 130 sticks out upward from the top surface of the field plate 120 through a through-hole 104 (see FIG. 5) of the field plate 120. For example, an erected pin 122 for each player figure 300 for an overhead bicycle shot (described later) is inserted in a support member 320. An erected pin 122 for each player FIG. 160 is inserted in a pivot foot 161 (example pivot portion) of the player FIG. 160 (see FIG. 8). In this manner, each player FIG. 160 is held by the associated figure mounting stage 129.

When a user advances or retreats the grip portion 131 of a manipulation lever 130 in its axial direction, the associated player FIG. 160 is moved along the associated through-hole 104 of the field plate 120.

When the user rotates the grip portion 131 of a manipulation lever 130 about its axis, gears provided inside the associated figure mounting stage 129 are rotated and the erected pin 122 that is connected one of the gears is rotated. As the erected pin 122 is rotated, the player FIG. 160 is rotated about its pivot foot 161 which is fixed to the erected pin 122.

Figure 5:
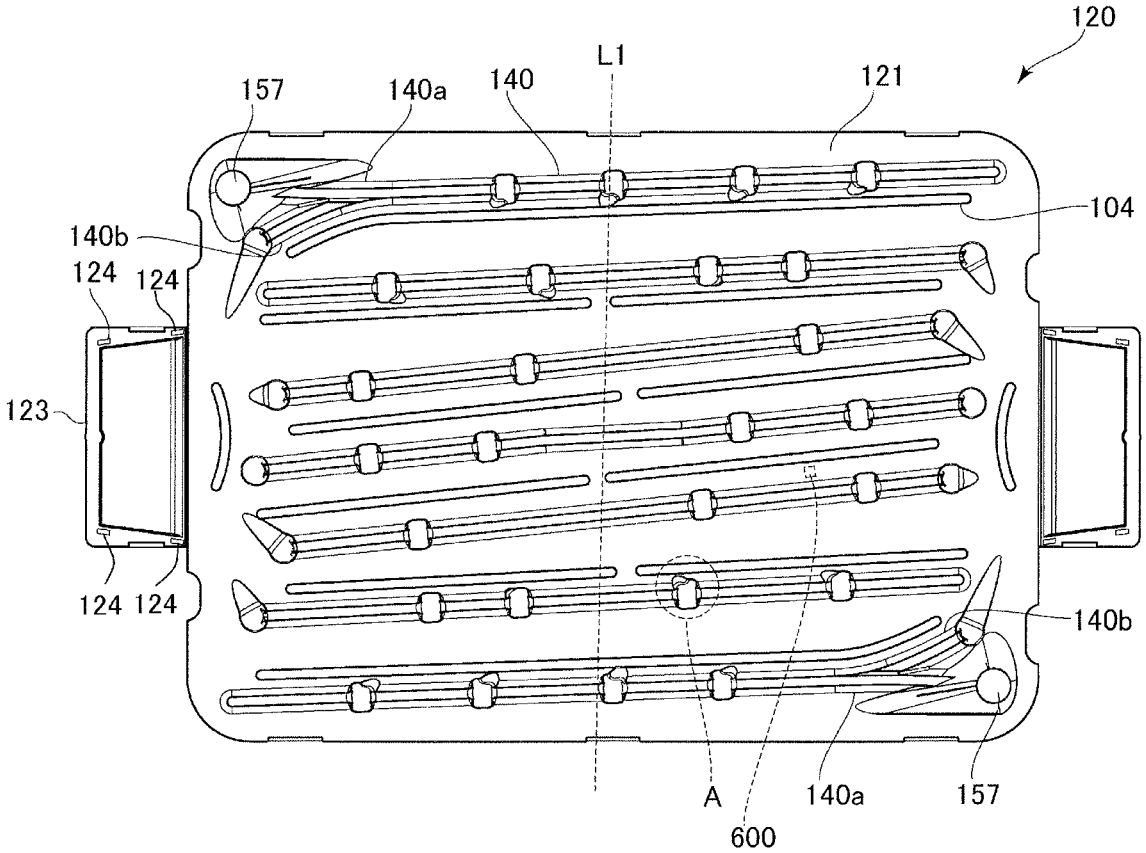
FIG. 5 is a plan view of the field plate.

FIG. 5 is a plan view of the field plate 120. As shown in FIG. 5, the field plate 120 has a generally rectangular flat plate 121 which is rounded at the corners and goal area portions 123 which are provided at the centers of the two shorter sides of the flat plate 121.

An even number of through-holes 104 penetrate through the flat plate 121 so as to extend approximately parallel with the longer sides of the flat plate 121.

Corner holes 157 are formed near two respective diagonal corners of the field plate 120. The two corner holes 157 are approximately circular (slightly elliptical) holes that are smaller in diameter than a ball 500 (see FIG. 8). A portion, around each corner hole 157, of the field plate 120 is recessed slightly with the corner hole 157 as the center and hence each corner hole 157 can receive a ball 500 when it rolls and comes close to the associated corner of the field plate 120.

In a state that the field plate 120 is attached to the main body 110, a circumferential end portion of the field plate 120 is supported by the field plate receiving portion 114 of the main body 110 and the goal area portions 123 of the field plate 120 are fitted in the respective recesses 118 of the main body 110.

Each goal area portion 123 is formed with through-holes 124 at its four respective corners.

The back surface of the field plate 120 is provided with a magnet 600 (example first magnet) approximately at the middle between the line (denoted by symbol L1 in FIG. 5) passing through the centers of the two longer sides of the field plate 120 and each shorter side of the field plate 120.

<Ball Holding Portions>

Figure 6:
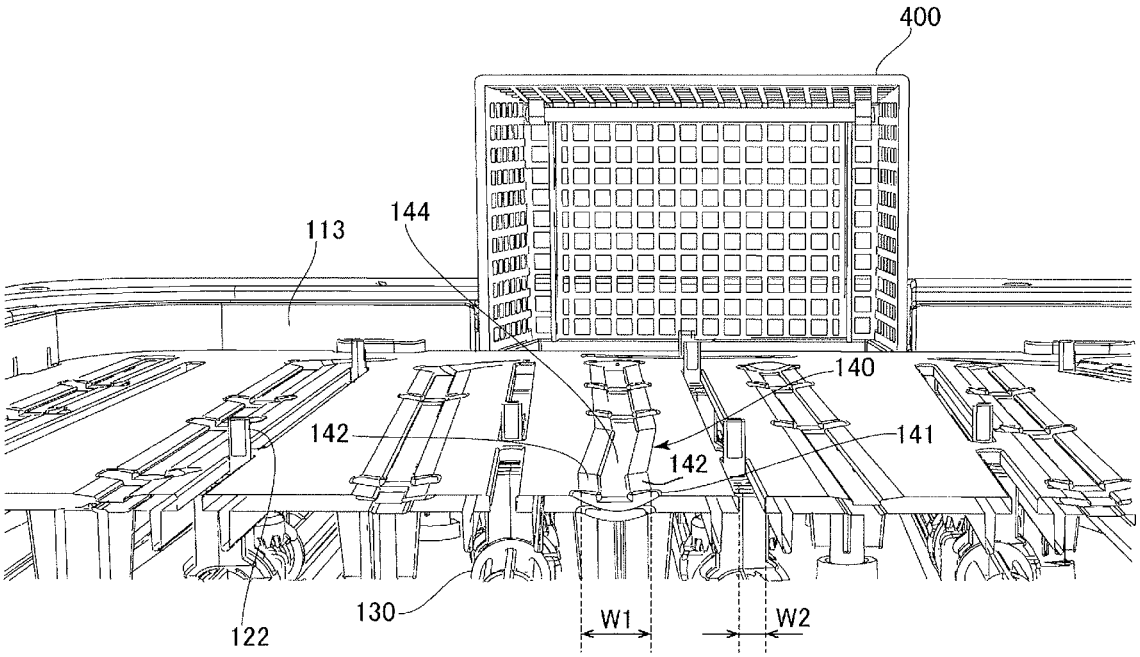
FIG. 6 is a sectional view of the game board taken along an arrowed line vi-vi in FIG. 1.
Figure 7:
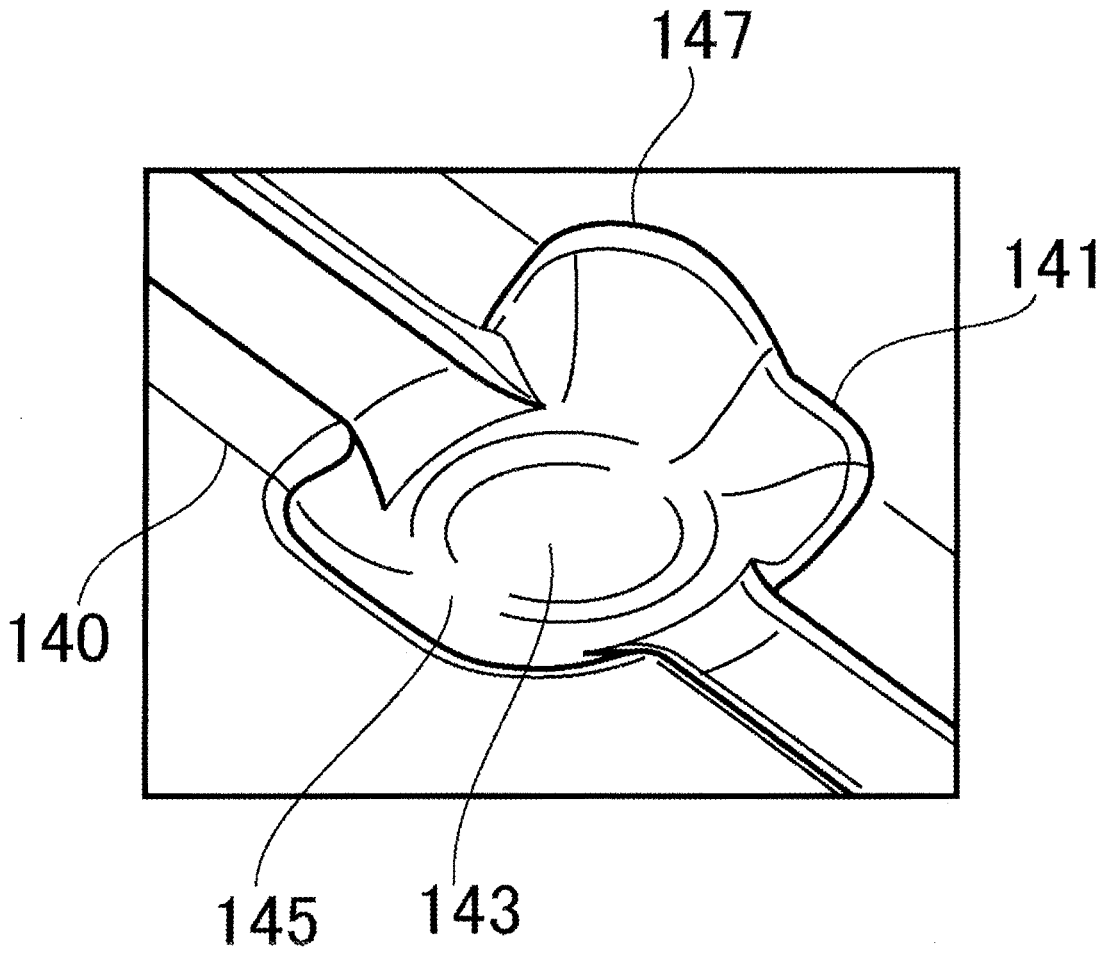
FIG. 7 is an enlarged perspective view of part A in FIG. 5.

FIG. 6 is a sectional view of the game board 100 taken along an arrowed line vi-vi in FIG. 1. FIG. 7 is an enlarged perspective view of part A in FIG. 5. As shown in FIGS. 5-7, the field plate 120 is formed with grooves 140 (example ball holding portions) beside the through-holes 104. The grooves 140 are approximately straight and extend parallel with the through-holes 104. Each of the above-mentioned magnets 600 is disposed between the associated groove 140 and through-hole 104. Each of the grooves 140 closest to the respective longer sides of the field plate 120 branches off at one tip. One branch 140*a* extends to the associated corner hole 157 of the field plate 120 and the other branch 140*b* is curved toward the associated goal (see FIG. 5).

Each groove 140 is shaped like a dish in cross section and has two slant surfaces 142 and a bottom surface 144 which is located between the two slant surfaces 142. The horizontal width W1 of each groove 140 is greater than the horizontal width W2 of each through-hole 104.

Recesses 141 which are wider than each groove 140 are arranged along the groove 140 at prescribed intervals. Each recess 141 is shaped like a dish and has an approximately circular bottom surface 143 and a circumferential wall 145 which surrounds the bottom surface 143. Each recess 141 is wider than each groove 140; that is, the largest diameter of the circumferential wall 145 of each recess 141 is greater than the horizontal width W1 of each groove 140.

Part of the recesses 141 have a guide portion 147 which is formed in such a manner that a portion of the circumferential wall 145 extends in a prescribed direction. The term "prescribed direction" as used herein includes a direction toward the goal (shooting direction) or a direction toward an area in front of the goal (centering direction). The guide portion 147 of each of recesses 141 located in the vicinities of each goal are tapered toward the goal.

Figure 8:
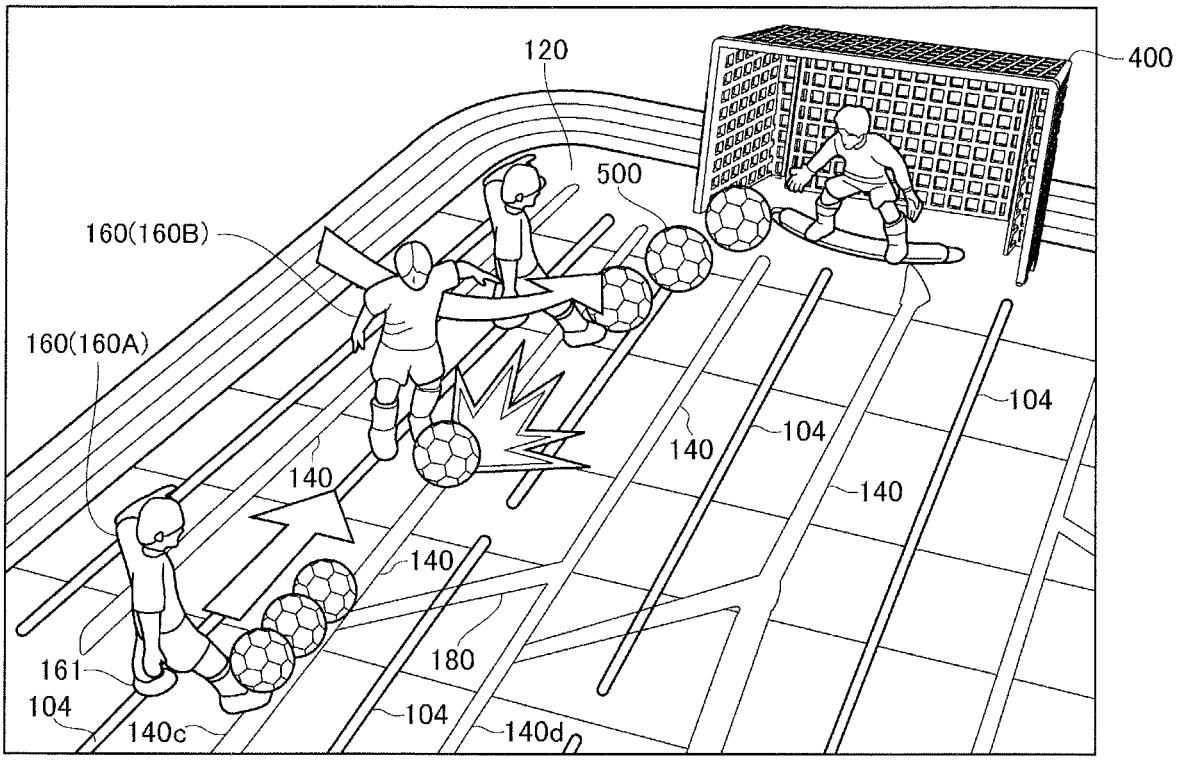
FIG. 8 is a schematic diagram showing how a player figure traps a ball and then shoots at goal.

FIG. 8 is a schematic diagram showing how a player FIG. 160 traps a ball 500 and then shoots at goal. As shown in FIG. 8, the field plate 120 may be formed with, between a first groove 140*c* and a second groove 140*d* of the plural grooves 140, a crossing groove 180 which extends obliquely passing a through-hole 104 and connects the first groove 140*c* and the second groove 140*d*.

In the above configuration, a ball 500 can stay in a groove 140 that is formed beside the associated through-hole 104. Each groove 140 in which a ball 500 may stay is formed beside the associated through-hole 104 along which a player FIG. 160 (160A or 160B) is to be moved rather than shares the same axis as the latter. As a result, a user can bring a portion of a player FIG. 160 into contact with a ball 500 at any of various angles and thereby move the ball 500 to any of various directions by rotating the manipulation lever 130 while adjusting the distance between its portion to come into contact with the ball 500 recognizing the distance visually.

As such, the above configuration makes it possible to provide a game board 100 capable of increasing the degree of freedom of the direction in which a ball 500 can be moved.

For example, as shown in FIG. 8, the user can cause a player FIG. 160A to move, accurately, a ball 500 being held in a groove 140 toward a player 160B that is located in front of the goal (i.e., pass the ball 500 to the player 160B). Furthermore, the user can cause a player FIG. 160B that has trapped a ball 500 to shoot at goal with the foot (right foot) that is different from the pivot foot (left foot) aiming at a position where a keeper player figure is not located.

With the above structures, a ball 500 may stay in a recess 141 (see FIGS. 2 and 7) rather than a groove 140. When a ball 500 stays in a recess 141, it is stopped stably and hence the user can easily move the ball 500 in any of various directions.

With the above structures, when a ball 500 is moved by a player FIG. 160 from a recess 141, the guide 147 (see FIG. 7) can guide the ball toward the goal or in a centering direction. This increases the variety of game tactics and room to reflect the tastes of a user.

With the above structures, the direction in which a player FIG. 160 moves a ball 500 located in a groove 140 can be guided so as to be directed to, for example, a corner or the goal. This increases the variety of game tactics and room to reflect the tastes of a user.

With the above structures, a player FIG. 160 can move a ball 500 from a first groove 140*c* to a second groove 140*d* via a crossing groove 180. This increases the variety of game tactics and room to reflect the tastes of a user.

With the above structures, a ball 500 tends to stay more often in a long groove 140 which is formed beside the associated through-hole 104 along which a player FIG. 160 is to move than in the associated through-hole 104. Thus, the user can move a ball 500 easily in any of various directions using a long groove 140. This increases the variety of game tactics and room to reflect the tastes of a user.

<Launching Mechanisms 201>

Figure 9A:
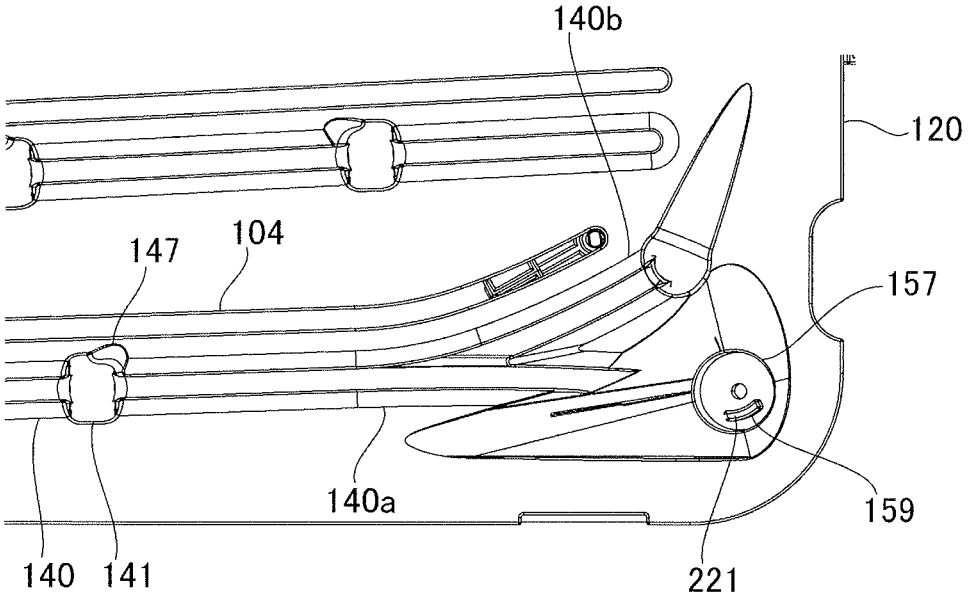
FIG. 9A is a plan view of a part, around a launching mechanism, of the game board.
Figure 9B:
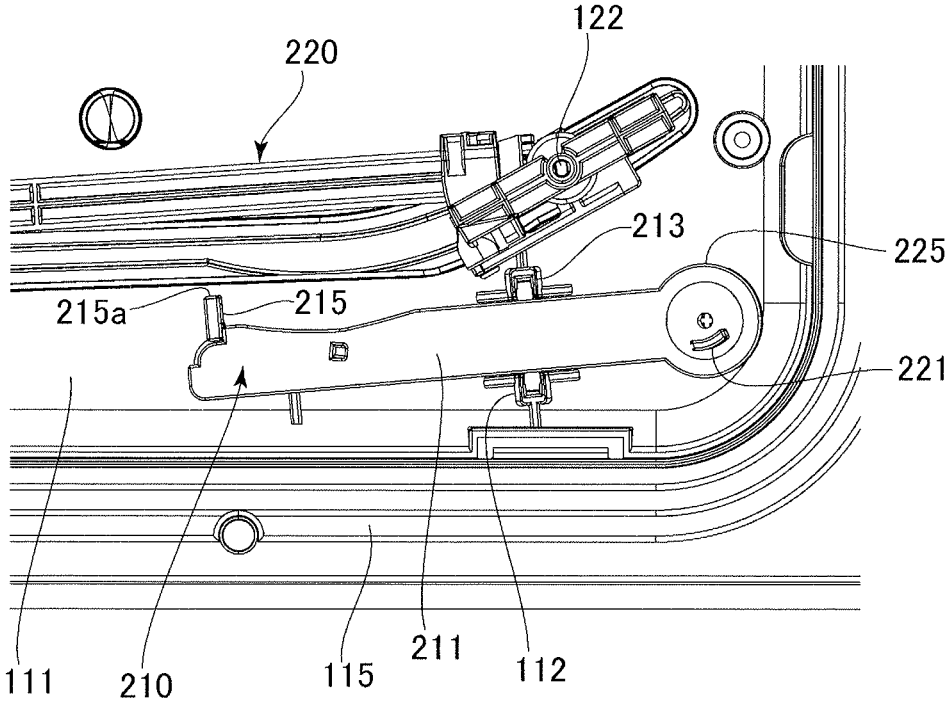
FIG. 9B is a plan view of the part, around the launching mechanism, of the game board with the field plate removed.
Figure 10:
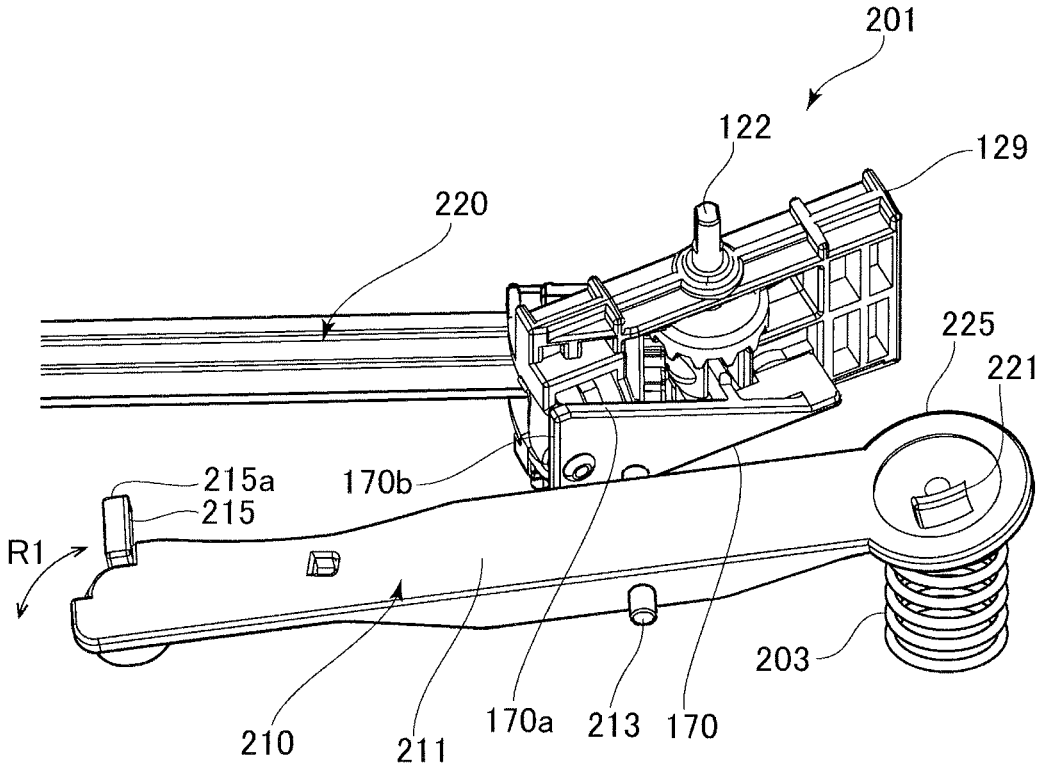
FIG. 10 is a perspective view of the launching mechanism.

FIG. 9A is a plan view of a part, around a launching mechanism 201, of the game board 100, and FIG. 9B is a plan view of the part, around the launching mechanism 201, of the game board 100 with the field plate 120 removed. FIG. 10 is a perspective view of the launching mechanism 201. Each launching mechanism 201 is composed of a launching member 210, an elastic member 203, and a pressing portion 170 for compressing the elastic member 203 cooperating with the launching member 210.

As shown in FIGS. 9A and 9B and FIG. 10, the launching member 210 has a body 211, an end portion 225, rotary shafts 213, and a contact portion 215. The body 211 is shaped like a long plate. The end portion 225 is shaped like an approximately circular dish and is formed at one end of the body 211 in its longitudinal direction. The top surface of the bottom portion of the end portion 225 is formed with a projection 221 which is arc-shaped in a top view.

The contact portion 215 is shaped like a cuboid and is disposed so as to be rotatable with respect to the body 211 about a vertical rotation axis that is perpendicular to the rotary shafts 213. In a state that the contact portion 215 is not in contact with any other member, the posture of the contact portion 215 is fixed by a spring member (not shown) so that its tip portion 215*a* is directed to the associated manipulation lever 220 (see FIG. 10).

The rotary shafts 213 are located approximately at the center of the body 211 of the launching member 210 in its longitudinal direction. The rotary shafts 213 are shaped like cylindrical poles and project outward from the two respective longer-side side surfaces of the body 211. The rotary shafts 213 are supported rotatably by respective bearing portions 112 which are provided on the bottom plate 111 of the main body 110 of the game board 100.

The launching member 210 is supported so as to be swingable in the vertical direction with respect to the bottom plate 111 of the main body 110 of the game board 100 with the rotary shafts 213 as a swing center axis. The launching member 210 is disposed so that the end portion 225 is located in the vicinity of the corner of the bottom plate 111 of the main body 110 of the game board 100 and the body 211 of the long launching member 210 extends parallel with the longer side of the main body 110 of the game board 100.

The corner hole 157 of the field plate 120 is formed with a through-hole 159 which is arc-shaped in a top view, and is disposed so that the projection 221 of the launching member 210 projects through the through-hole 159 in a state that the field plate 120 is attached to the main body 110. A narrow gap is secured between the projection 221 and the through-hole 159 so that the projection 221 can project through the through-hole 159.

The elastic member 203 is a coil spring, for example. One end of the elastic member 203 is connected and fixed to the bottom plate 111 of the main body 110 of the game board 100, and its other end is connected and fixed to the back surface of the end portion 225 of the launching member 210. The elastic member 203 is thus disposed between the bottom plate 111 of the main body 110 and the end portion 225 of the launching member 210. Although in the embodiment the coil spring is employed as an example of the elastic member 203, the invention is not limited to this case. It suffices that the elastic member 203 be a component that functions in an elastic manner; the elastic member 203 may be a leaf spring, a rubber spring, or the like.

As shown in FIGS. 3 and 10, the figure mounting stage 129 that is disposed at the tip of the rod-shaped portion 132 of each of the manipulation levers 130, closest to the respective longer sides of the main body 110, among the plural manipulation levers 130 has a pressing portion 170. The pressing portion 170 is provided on the side surface that is opposed to the launching member 210 among the surfaces of the cuboid-shaped figure mounting stage 129. The pressing portion 170 has a slant surface 170*a* which is inclined so as to come closer to the bottom plate 111 of the main body 110 of the game board 100 as the position goes from the rear surface of the figure mounting stage 129 to its front surface. The pressing portion 170 is shaped like a right triangle in a side view, and the slant surface 170*a* corresponds to its hypotenuse that is opposed to its right angle.

<Operation of Launching Mechanisms 201>

Figures 11A, 11B, 11C:
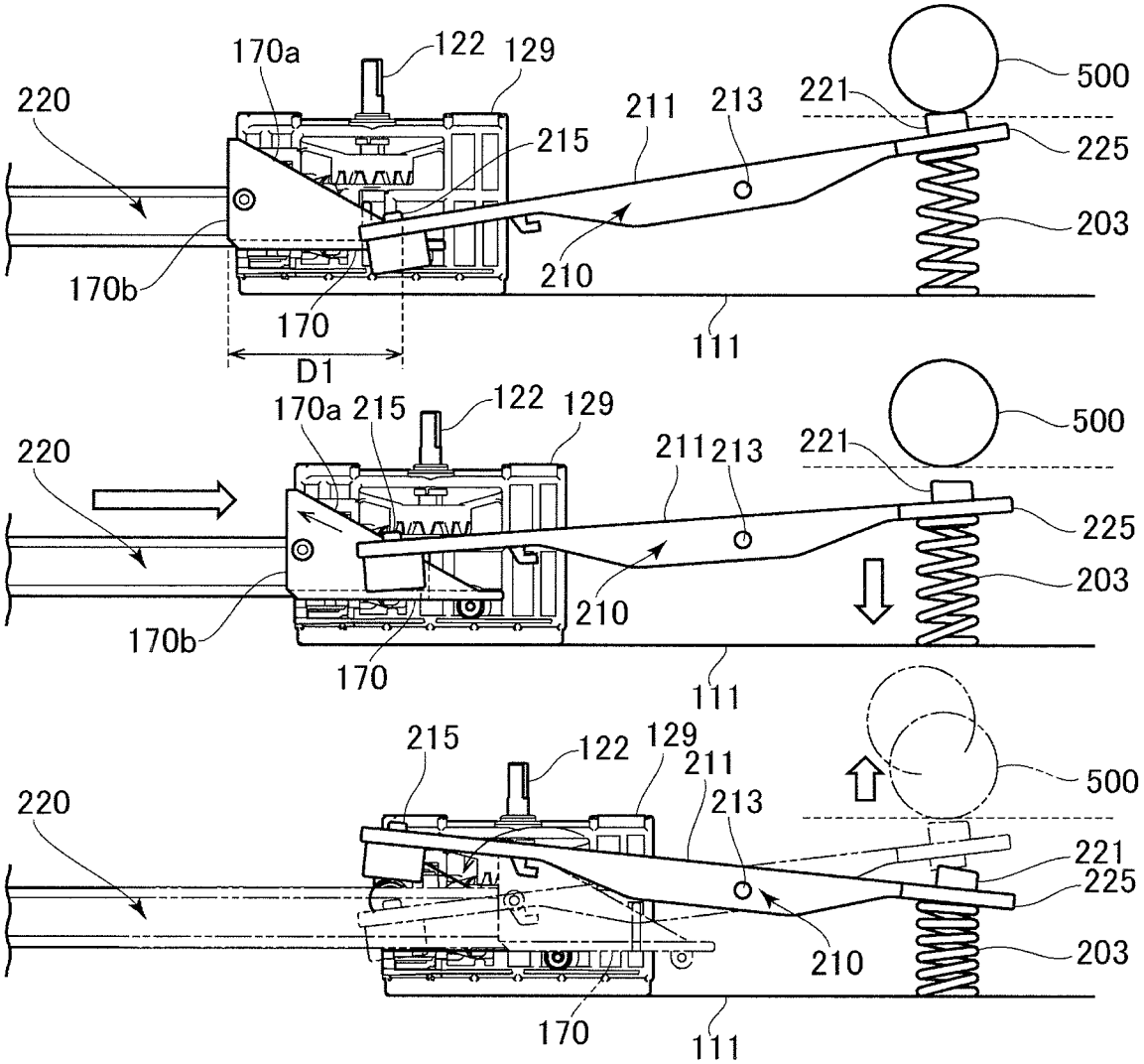
FIGS. 11A-11C are schematic diagrams illustrating how the launching mechanism operates.

FIGS. 11A-11C are schematic diagrams illustrating how each launching mechanism 201 operates. FIG. 11A shows a state that the slant surface 170*a* of the pressing portion 170 starts coming into contact with the contact portion 215 of the launching member 210, FIG. 11B shows a state that the contact portion 215 of the launching member 210 is going up across the slant surface 170*a* of the pressing portion 170, and FIG. 11C shows a state that the contact portion 215 of the launching member 210 has just gone over the slant surface 170*a* of the pressing portion 170.

As shown in FIG. 11A, when the user advances the manipulation lever 220 (toward the opponent's goal) along the groove 117 of the bottom plate 111, the contact portion 215 of the launching member 210 comes into contact with the slant surface 170*a* of the pressing portion 170 at its low position. At this time, a portion of the projection 221 projects through the through-hole 159 and supports a ball 500 together with the bottom surface of the corner hole 157 where the through-hole 159 is formed.

When the user advances the manipulation lever 220 further, as shown in FIG. 11B the launching member 210 is rotated about the rotary shafts 213 and the contact portion 215 of the launching member 210 is pushed up being kept in contact with the slant surface 170*a* of the pressing portion 170. At the same time, the end portion 225 of the launching member 210 is moved downward and the elastic member 203 which is disposed between the end portion 225 and the bottom plate 111 is compressed. As the end portion 225 of the launching member 210 is moved downward, the projection 221 the portion of which projected through the through-hole 159 goes down to leave the bottom surface of the corner hole 157 and is separated from the ball 500.

When the user advances the manipulation lever 220 still further until the contact portion 215 goes over the top end of the slant surface 170*a*, as shown in FIG. 11C the compression state of the elastic member 203 is canceled, whereupon the launching member 210 is rotated about the rotary shafts 213 and the end portion 225 which is connected to the elastic member 203 is elevated toward the through-hole 159. As the end portion 225 is elevated, the projection 221 of the end portion 225 goes out of the through-hole 159 at a fast speed. As a result, the ball 500 that has been held on the bottom surface of the corner hole 157 is launched toward an area in front of the goal area portion 123.

When the user retreats the manipulation lever 220 and a rear end surface 170*b* of the pressing portion 170 comes into contact with the contact portion 215, the contact portion 215 is rotated in the direction in which the manipulation lever 220 retreats (indicated by arrow R1 in FIG. 10). Thus, the user can pull back the manipulation lever 220 without the pressing portion 170's being caught on the contact portion 215. After the pressing portion 170 passes the contact portion 215, the contact portion 215 recovers its posture that the tip portion 215*a* is directed to the manipulation lever 220 through action of the spring member (not shown).

With the above structures, the projection 221 can be elevated using an elastic force produced by the elastic member 203 that is compressed as a result of a movement of the manipulation lever 220 by a prescribed distance D1 shown in FIG. 11A. As a result, a ball 500 can be launched by the elastic force produced by the elastic member 203 irrespective of a force that the user applies to the manipulation lever 220 to move it. Thus, the user need not pay attention to the force of a manipulation he or she performs to launch a ball 500 and hence can concentrate on a manipulation that should be performed to hit the launched ball 500 in a well-timed manner. Furthermore, since the elastic force produced by the elastic member 203 that is compressed by a movement of the manipulation lever 220 by the prescribed distance D1 is always the same, a locus and a speed of a ball 500 that is launched from the corner hole 157 into the air can be predicted easily. Thus, the timing to move a player FIG. 160 to cause it to shoot at goal can be adjusted easily.

As such, the above structures make it possible to provide a game board capable of lowering the difficulty of a manipulation for causing the player FIG. 160 to hit a launched ball 500.

With the above structures, the swingable launching member 210 and the manipulation lever 220 are arranged parallel with each other. Thus, the movement distance (prescribed distance) for compressing the elastic member 203 can be made long more easily than in a case that the launching member 210 and the manipulation lever 220 are arranged so as to cross each other. As a result, the elastic member 203 can be compressed gradually by a relatively weak force as the manipulation lever 220 is moved. This provides an advantage that the influence on a manipulation feeling of the user can be made small when a manipulation for compressing the elastic member 203 is performed.

<Player Figures 300 for Overhead Bicycle Shot>

Figure 12A:
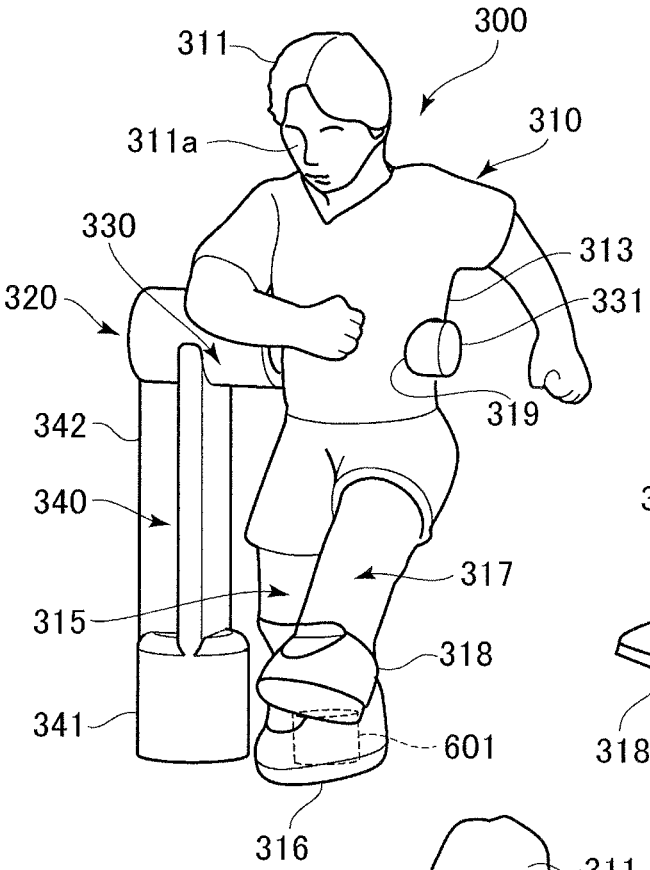
FIG. 12A is a perspective view of a player figure.
Figure 12B:
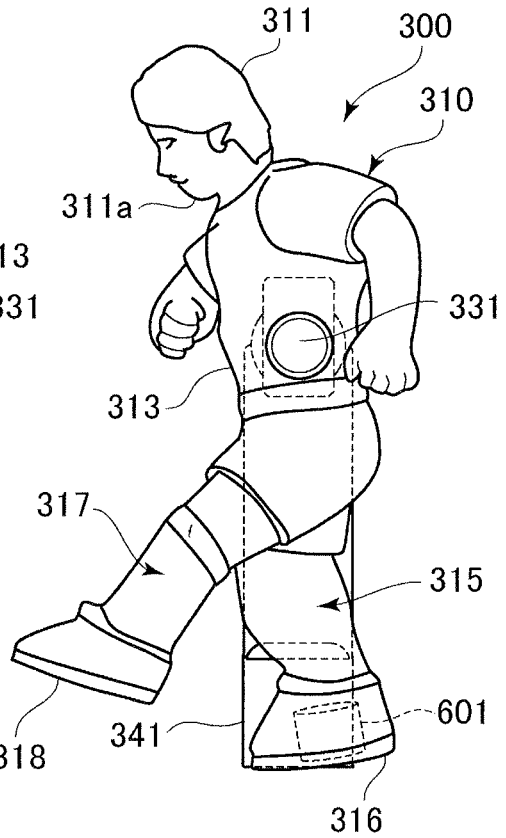
FIG. 12B is a side view of the player figure.
Figure 12C:
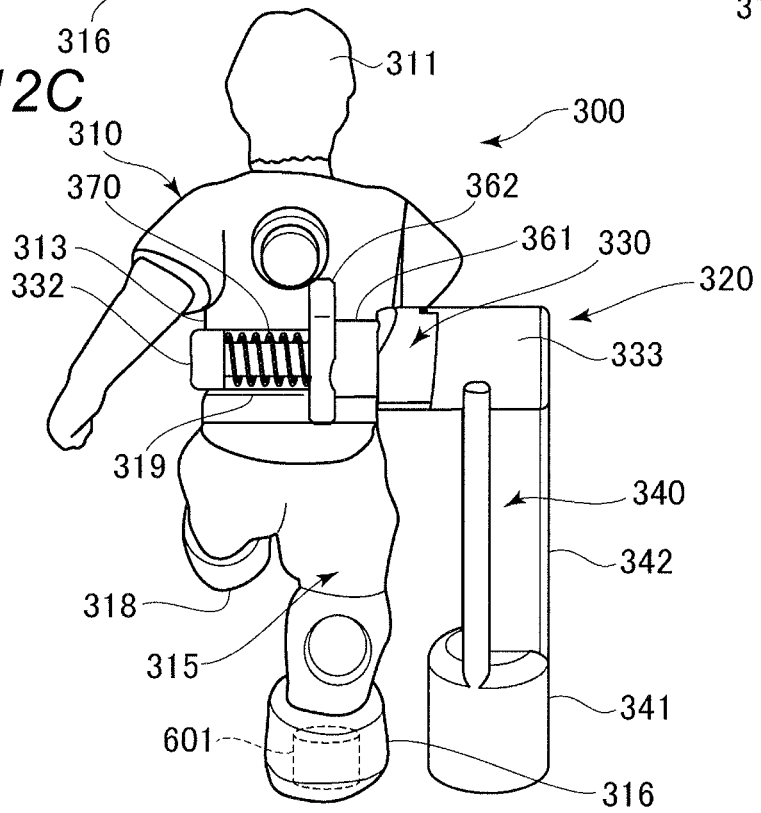

FIG. 12A is a perspective view of a player figure 300, FIG. 12B is a side view of the player figure 300, and FIG. 12C is a rear view of the player figure 300 part of whose torso is seen through.

As shown in FIGS. 12A-12C, the player figure 300 for an overhead bicycle shot has an appearance that simulates a soccer player and is composed of a player figure body 310 and a support member 320. The center of gravity of the player figure body 310 is located at a low position.

The player figure body 310 has a head 311 including a face 311*a*, a torso 313 which is formed with two arms, a right leg 315, and a left leg 317. The torso 313 has a circular through-hole 319 which is formed through its belly horizontally. The right leg 315 extends from the torso 313 downward approximately in the vertical direction and has a right foot 316 at its bottom end. The right foot 316 has a magnet 601 (example second magnet) inside. The left leg 317 extends from the torso 313 down forward and has a left foot 318 at its bottom end.

Figure 13A:
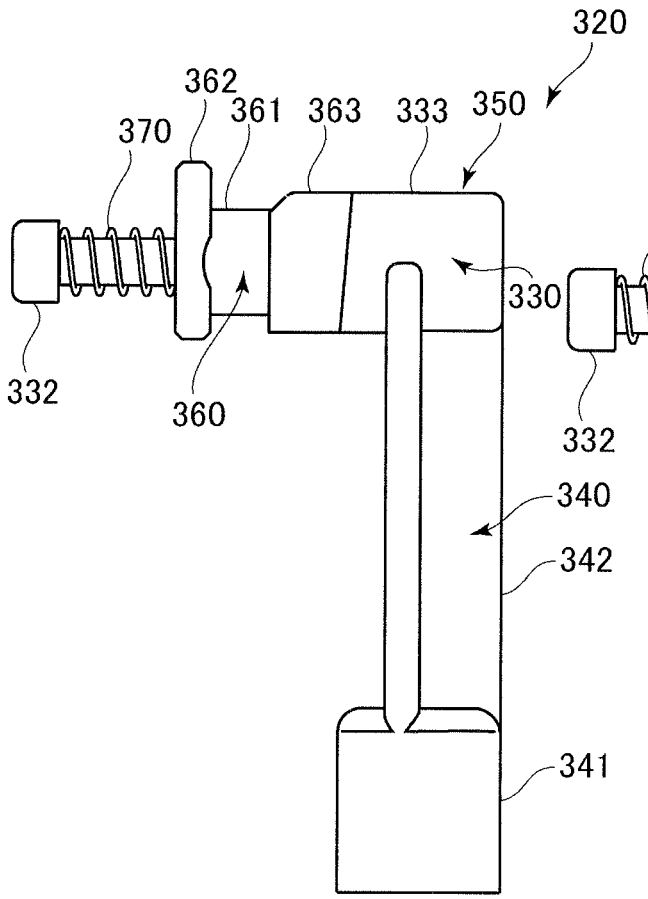
FIG. 13A is a rear view of a support member of the player figure.
Figure 13B:
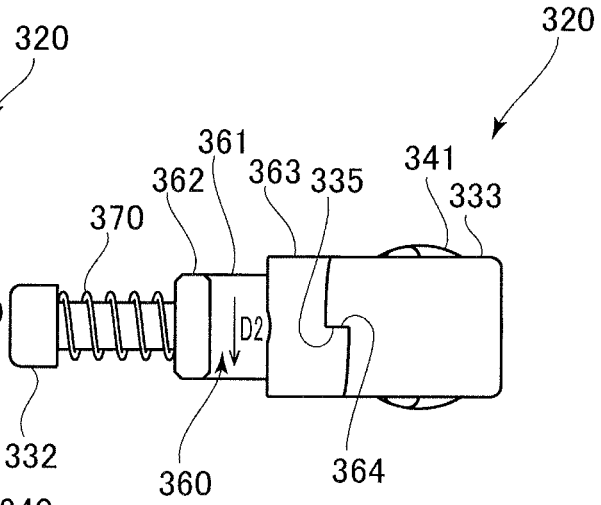
FIG. 13B is a plan view of the support member of the player figure.
Figure 13C:
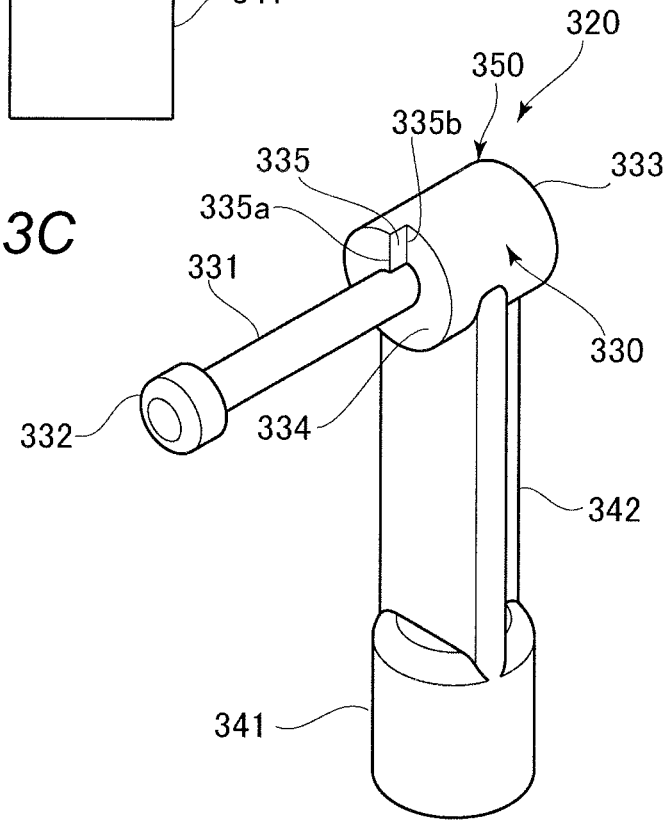
FIG. 13C is a perspective view of a main body of the support member of the player figure.

FIG. 13A is a rear view of the support member 320 of the player figure 300, FIG. 13B is a plan view of the support member 320 of the player figure 300, and FIG. 13C is a perspective view of a main body 350 of the support member 320 of the player figure 300.

As shown in FIGS. 13A-13C, the support member 320 of the player figure 300 has an inverted-L-shaped main body 350, a rotation restriction portion 360, and an elastic member 370. The main body 350 of the support member 320 has a first shaft portion 330 and a second shaft portion 340.

The first shaft portion 330 has a rod-shaped shaft rod 331 which extends horizontally, a tip portion 332 which is formed at the front end of the shaft rod 331 so as to be approximately shaped like a thin cylinder and is lager in diameter than the shaft rod 331, and a cylindrical rear end portion 333 which extends horizontally, is formed at the rear end of the shaft rod 331 and is lager in diameter than the shaft rod 331.

The rear end of the shaft rod 331 is connected to a generally circular front surface 334 of the rear end portion 333 at its center. The front surface 334 of the rear end portion 333 is formed with a step portion 335. The front surface 334 of the rear end portion 333 is a slant surface that is inclined rearward gently as the position goes counterclockwise in the circumferential direction of the shaft rod 331 from a front end 335*a* of the step portion 335 to its rear end 335*b* when the front surface 334 is viewed from the front side (a diagonally left front of FIG. 13C).

The second shaft portion 340 has a cylindrical pedestal 341 and a pillar 342 which is T-shaped in cross section. The top end of the pillar 342 is connected to a bottom surface of the rear end portion 333. The bottom end of the pillar 342 is connected to the top end of the pedestal 341. The bottom surface of the pedestal 341 is formed with a recess (not shown) in which the erected pin 122 can be inserted.

The rotation restriction portion 360 has a cylindrical portion 361, an engagement portion 362 which is approximately shaped like a thin cuboid and connected to the front surface of the cylindrical portion 361, and a cylindrical rear end portion 363 which is larger in diameter than the cylindrical portion 361 and is connected to the rear surface of the cylindrical portion 361. The engagement portion 362 is disposed inside and fixed to the torso 313 of the player figure body 310 (see FIGS. 12A-12C) and thereby supports the player figure body 310.

The rear surface of the rear end portion 363 of the rotation restriction portion 360 is inclined so as to be able to be opposed to and come into contact with the front surface 334 of the rear end portion 333 of the main body 350, and is formed with a step portion 364.

The rotation restriction portion 360 has a circular through-hole that penetrates through its cylindrical portion 361, engagement portion 362, and rear end portion 363 at their centers. The rotation restriction portion 360 is attached to the shaft rod 331 of the first shaft portion 330 of the main body 350, that is, the first shaft portion 330 is inserted through the through-hole of the rotation restriction portion 360.

The elastic member 370 is attached to the shaft rod 331 of the first shaft portion 330 of the main body 350 and located between the tip portion 332 and the engagement portion 362. The front end of the elastic member 370 is in contact with the rear surface of the tip portion 332, and the rear end of the elastic member 370 is in contact with the front surface of the engagement portion 362.

The rear surface of the rear end portion 363 of the rotation restriction portion 360 is pressed against the front surface 334 of the rear end portion 333 of the main body 350 by an elastic force produced by the elastic member 370. In this state, the rotation restriction portion 360 can rotate together with the player figure body 310 in a first circumferential direction D2 shown in FIG. 13B. On the other hand, in this state, the rotation restriction portion 360 cannot rotate in the direction opposite to the first circumferential direction D2 because the step portion 364 is in contact with the step portion 335. In this manner, the rotation restriction portion 360 prevents the player figure body 310 from rotating in the direction opposite to the first circumferential direction D2 from the state shown in FIGS. 12A-12C and FIGS. 13A and 13B.

Thus, in the embodiment, the player figure body 310 can rotate vertically only in the direction in which the direction of the face 311*a* of the player figure body 310 turns upward from the horizontal direction of the field plate 120.

As shown in FIG. 13B, the step portions 364 and 335 are in surface contact with each other at the centers of the rear end portion 363 and the rear end portion 333 in the vertical direction as viewed in FIG. 13B which is a top view. Thus, when the player figure body 310 whose torso 313 is fixed to the engagement portion 362 starts to be rotated vertically, the state that the step portion 364 is in contact with the step portion 335 is canceled. After the end of the vertical rotation, the step portion 364 comes into contact with the step portion 335 again because of the presence of the elastic force produced by the elastic member 370 and the fact that the center of gravity of the player figure body 310 is located at the low position.

<Operation Relating to Overhead Bicycle Shot>

Figure 14A:
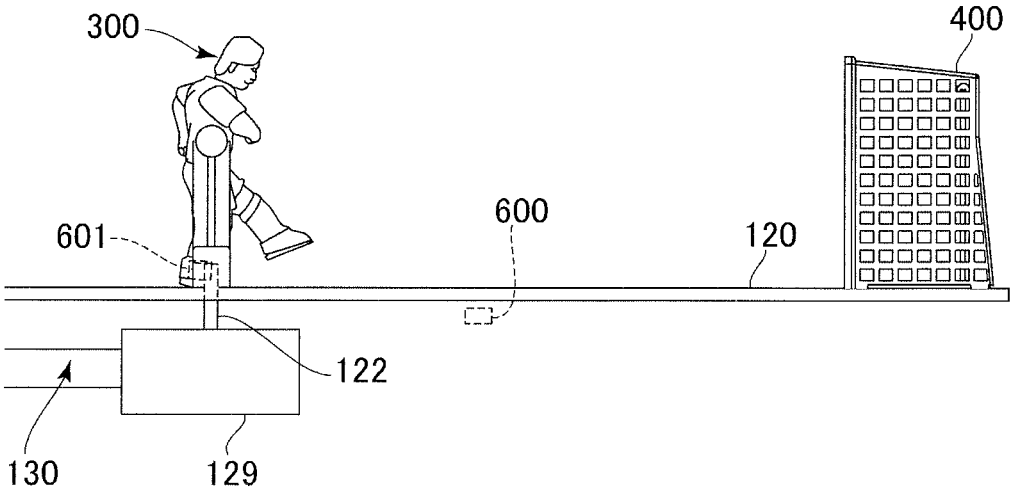
FIGS. 14A-14C are schematic diagrams illustrating a series of operations of a player figure when it performs an overhead bicycle shot.
Figure 14B:
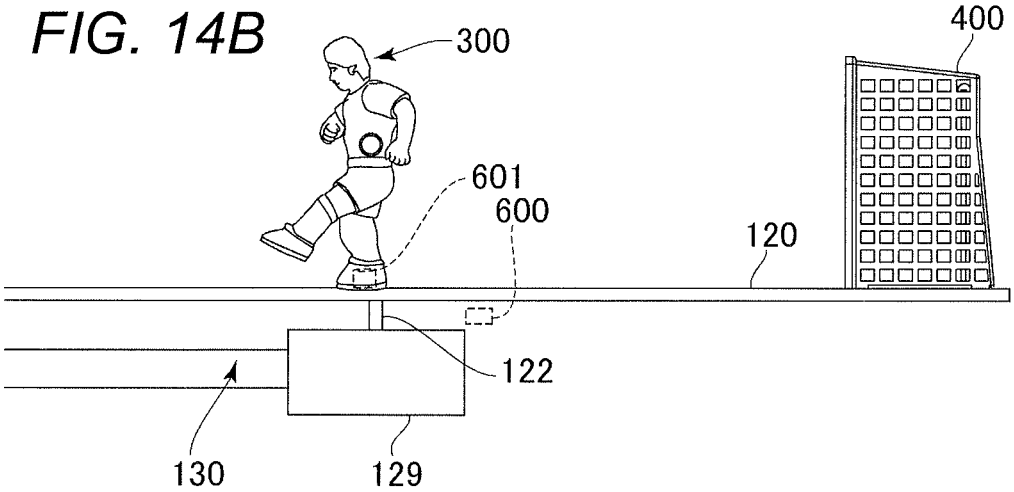
Figure 14C:
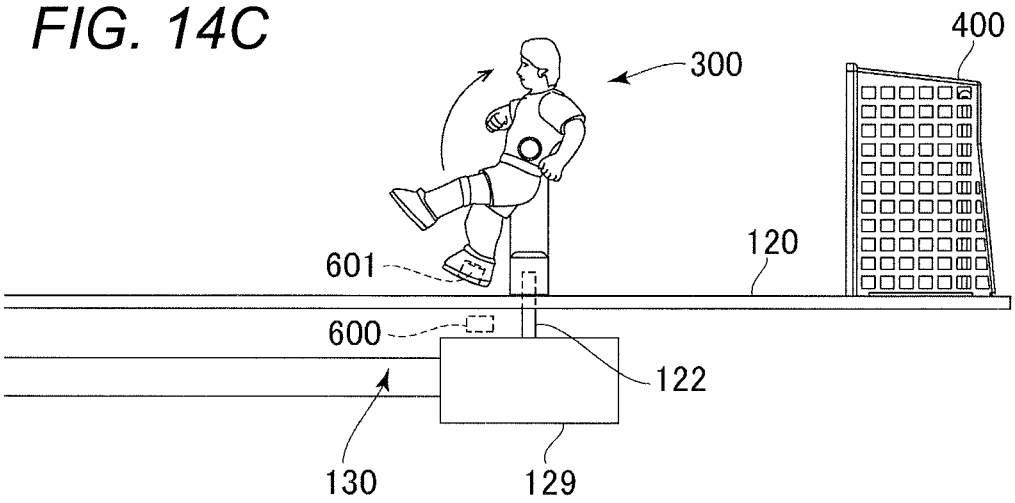

FIGS. 14A-14C are schematic diagrams illustrating a series of operations of a player figure 300 when it performs an overhead bicycle shot. FIG. 14A shows the player figure 300 that is advancing toward the opponent's goal, FIG. 14B shows a state that the player figure 300 has been turned horizontally so that its back faces the opponent's goal, and FIG. 14C shows an instant that the player figure 300 has started an overhead bicycle shot.

As shown in FIG. 14A, the user advances the manipulation lever 130 that is provided with the figure mounting stage 129 that is mounted with the overhead shot player figure 300. As a result, the overhead shot player figure 300 advances across the field plate 120 while continuing to face the goal member 400 of the opponent.

When the user has advanced the manipulation lever 130 further and the player figure 300 comes close to the magnet 600 which is attached to the back surface of the field plate 120, as shown in FIG. 14B the user rotates the grip portion 131 of the manipulation lever 130 about its axis. As a result, the gears provided inside the figure mounting stage 129 are rotated and the erected pin 122 that is connected to one of the gears is rotated. As the erected pin 122 is rotated, the player figure 300 is rotated horizontally about the second shaft portion 340 which includes the pedestal 341 to which the erected pin 122 is fixed. As a result, the player figure body 310 is rendered in a state that its back faces the opponent's goal. The right leg 315 of the player figure body 310 comes to be located on a line that is parallel with the longer sides of the field plate 120 and includes the point where the magnet 600 is located.

As shown in FIG. 14C, as the user advances the manipulation lever 130 while the back of the player figure body 310 continues to face the opponent's goal, the right foot 316 of the right leg 315 of the player figure body 310 passes over the magnet 600 which is attached to the back surface of the field plate 120. At this time, a repulsive force acts between the magnet 601 located inside the right foot 316 and the magnet 600 attached to the back surface of the field plate 120. The player figure body 310 starts to rotate vertically about the shaft rod 331 of the first shaft portion 330 due to the repulsive force and a force that acts on the player figure body 310 when the user advances the manipulation lever 130 toward the opponent's goal. After the end of the rotation, the posture of the player figure body 310 returns to the one shown in FIG. 14B.

Vertical rotation of the player figure body 310 is restricted by the rotation restriction portion 360. In a state that the player figure body 310 is directed forward as shown in FIG. 14A, the right foot 316 of the right leg 315 of the player figure body 310 does not pass over the magnet 600 which is attached to the back surface of the field plate 120. Furthermore, the center of gravity of the player figure body 310 is located at the low position. Because of these reasons, the player figure body 310 is prevented from rotate vertically when an overhead shot manipulation is not performed.

With the above structures, when a ball 500 is launched into the air, the user can cause the player figure body 310 to rotate vertically to make an overhead bicycle shot on the ball 500 by advancing the manipulation lever 130 to which the player figure 300 is attached.

Figure 15:
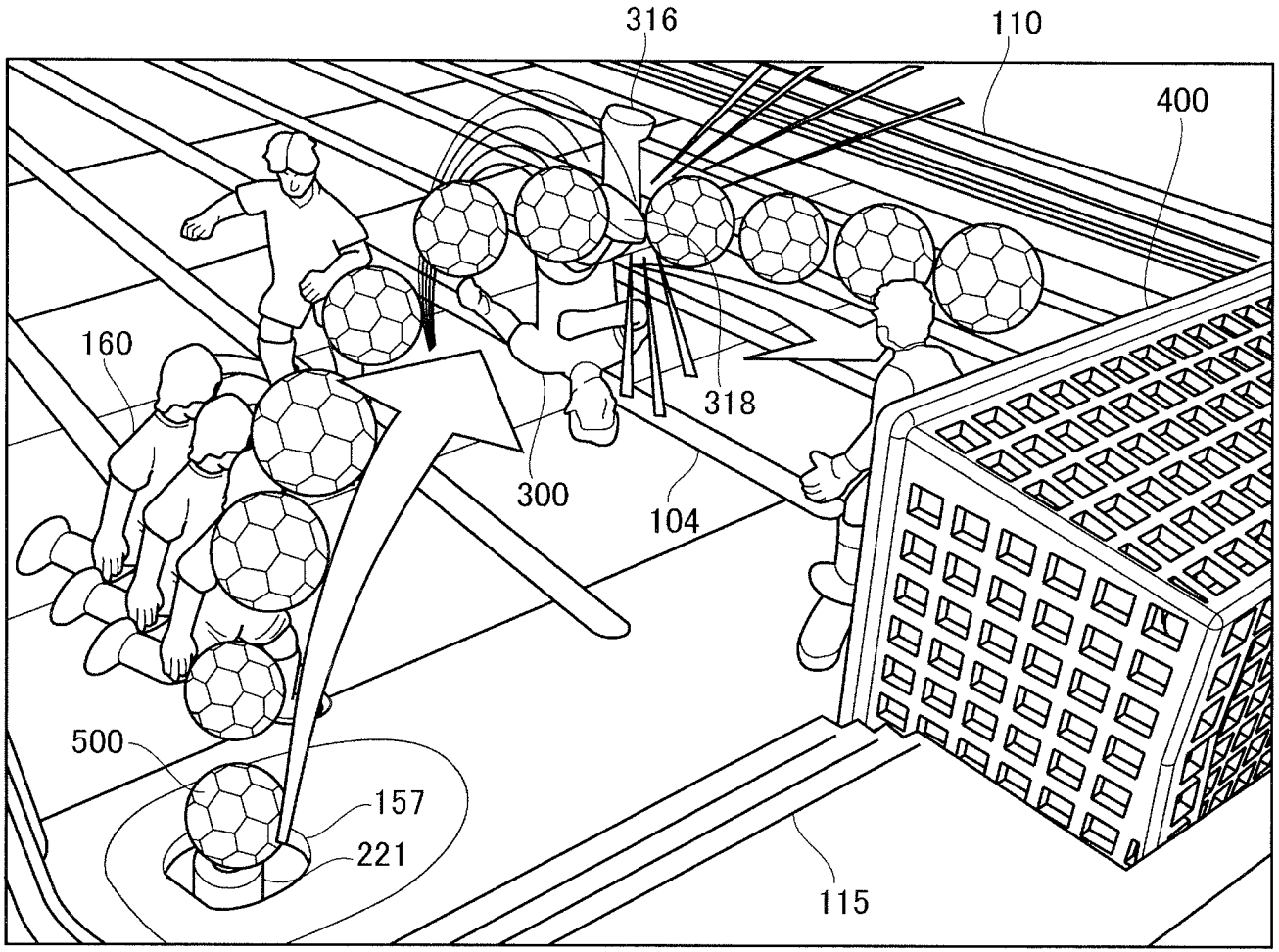
FIG. 15 is a schematic diagram illustrating how the player figure makes an overhead bicycle shot.

For example, as shown in FIG. 15 a ball 500 supported by the corner hole 157 is launched by the launching mechanism 201 toward an area in front of the goal area portion 123. The user advances the manipulation lever 130 so that the player figure 300 advances toward the launched ball 500, that is, toward the area in front of the goal area portion 123. Since the ball 500 that has been launched by the launching mechanism 201 reaches the area in front of the goal area portion 123 taking a prescribed locus, it is easy for the user to bring the left foot 318 of the player figure body 310 into contact with the ball 500. Thus, an overhead bicycle shot is likely made.

With the above structures, when a ball 500 is launched into the air by the launching mechanism 201, the user can cause the back of the player figure body 310 to face the opponent' goal by rotating the manipulation lever 130 to which the player figure 300 to make an overhead bicycle shot is attached and to cause the player figure body 310 to rotate vertically by advancing the manipulation lever 130.

With the above structures, if the front surface of the foot of the player figure body 310 hits a ball 500 located in front of the player figure 300 when it is rotated horizontally, the ball 500 can fly forward from the foot, without vertical rotation of the player figure body 310.

With the above structures, the user can cause the player figure body 310 to start an overhead bicycle shot smoothly at the position where the magnet 600 is disposed. This increases the variety of game tactics and room to reflect the tastes of a user.

<Goal Members 400>

Figure 16A:
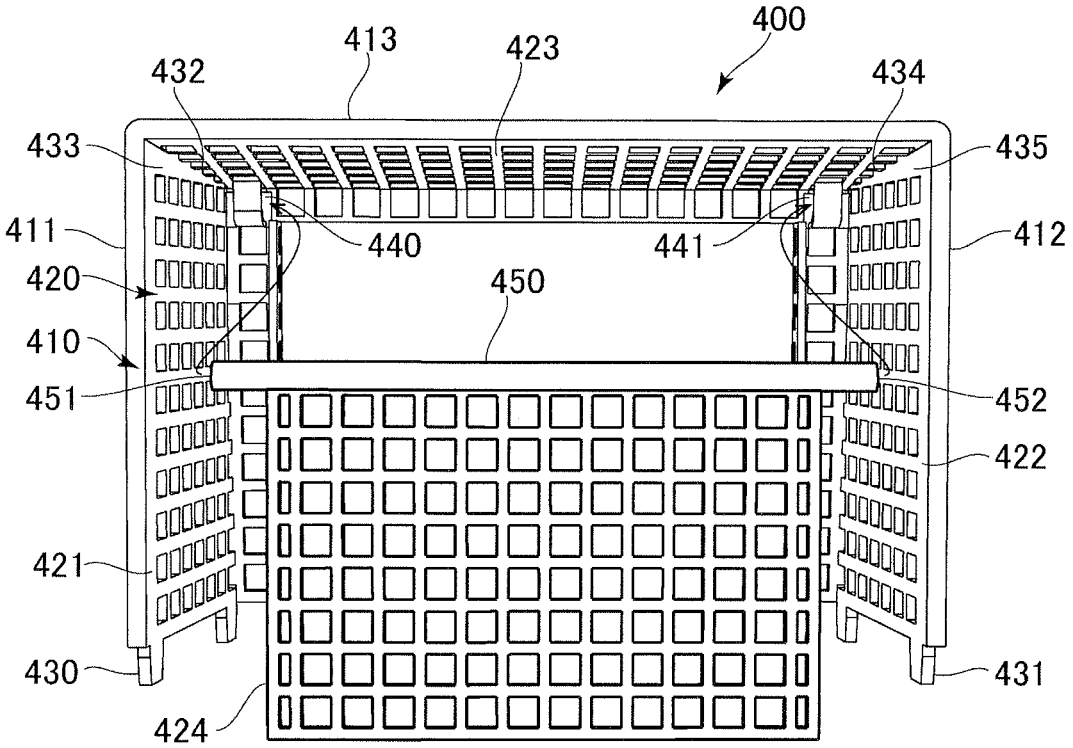
FIG. 16A is a front view of a goal member before attachment of a back portion and FIG. 16B is a front view of the goal member to which the back portion is attached.
Figure 16B:
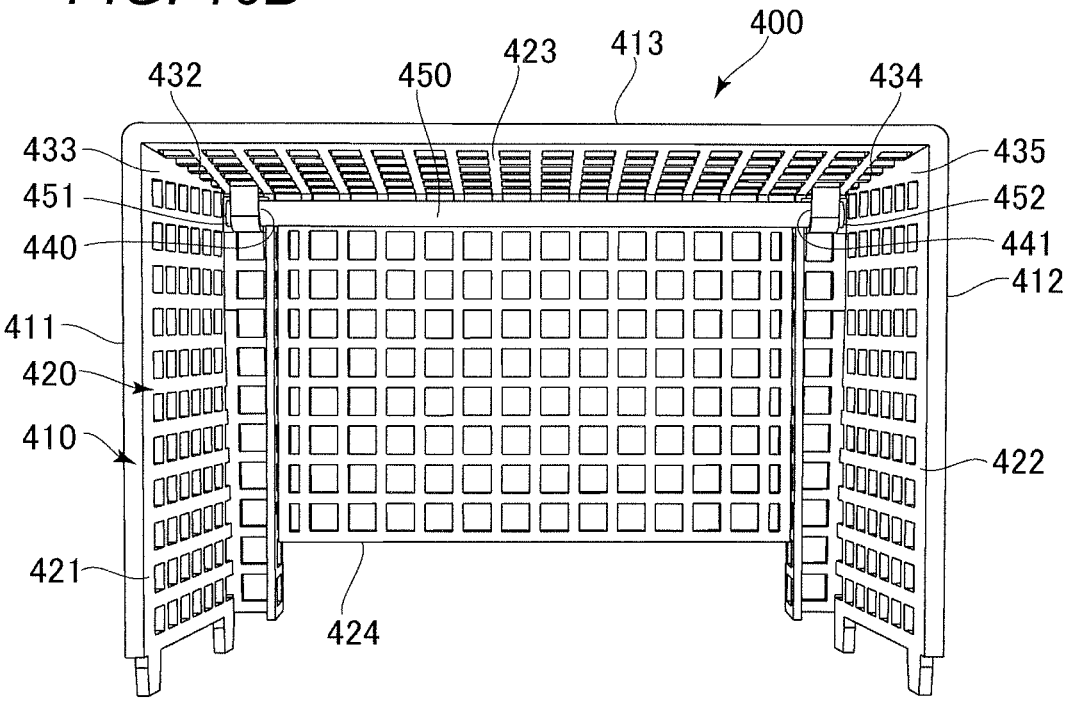

FIG. 16A is a front view of a goal member 400 before attachment of a back portion 424. FIG. 16B is a front view of the goal member 400 to which the back portion 424 is attached. As shown in FIGS. 16A and 16B, the goal member 400 has a goal post portion 410 and a goal net portion 420. The goal post portion 410 has a rod-shaped left post 411 which extends in the vertical direction, a rod-shaped right post 412 which extends in the vertical direction, and a rod-shaped goal bar 413 which extends in the horizontal direction so as to connect top end portions of the left post 411 and the right post 412. The goal net portion 420 has a left side portion 421, a right side portion 422, a ceiling portion 423, and the back portion 424.

The left side portion 421 has a vertically long rectangular shape and is connected to the rear surface of the left post 411. Left legs 430 project from the bottom surface of the left side portion 421 at front and rear end positions. The right side portion 422 has a vertically long rectangular shape and is connected to the rear surface of the right post 412. Right legs 431 project from the bottom surface of the right side portion 422 at front and rear end positions.

The ceiling portion 423 has a horizontally long rectangular shape and extends from the rear surface of the goal bar 413. A left end portion 432 of the ceiling portion 423 is connected to a top end portion 433 of the left side portion 421, and a right end portion 434 of the ceiling portion 423 is connected to a top end portion 435 of the right side portion 422.

A left bearing portion 440 is formed at a deep corner that is formed by the left side portion 421 and the ceiling portion 423. A right bearing portion 441 is formed at a deep corner that is formed by the right side portion 422 and the ceiling portion 423.

The back portion 424 has a horizontally long rectangular shape and has a rotary shaft portion 450 which is shaped like a rod and is longer than the longer sides of the back portion 424. A left end portion 451 of the rotary shaft portion 450 projects leftward from the left shorter side of the back portion 424, and a right end portion 452 of the rotary shaft portion 450 projects rightward from the right shorter side of the back portion 424. The left end portion 451 and the right end portion 452 are supported rotatably by the left bearing portion 440 and the right bearing portion 441, respectively.

The left legs 430 and the right legs 431, which are approximately shaped like a cuboid, are slightly smaller than and can be fitted in through-holes 124 which are formed at the four corners of the goal area portion 123, respectively.

In a state that each goal member 400 is set by fitting the legs 430 and 431 in the through-holes 124 of the goal area portion 123, a gap S1 is formed between the rear surface of the back portion 424 and the portion, opposed to the back portion 424, of the inner wall surface of the recess 118 (see FIG. 2).

<Operation of Goal Members 400>

Figure 17:
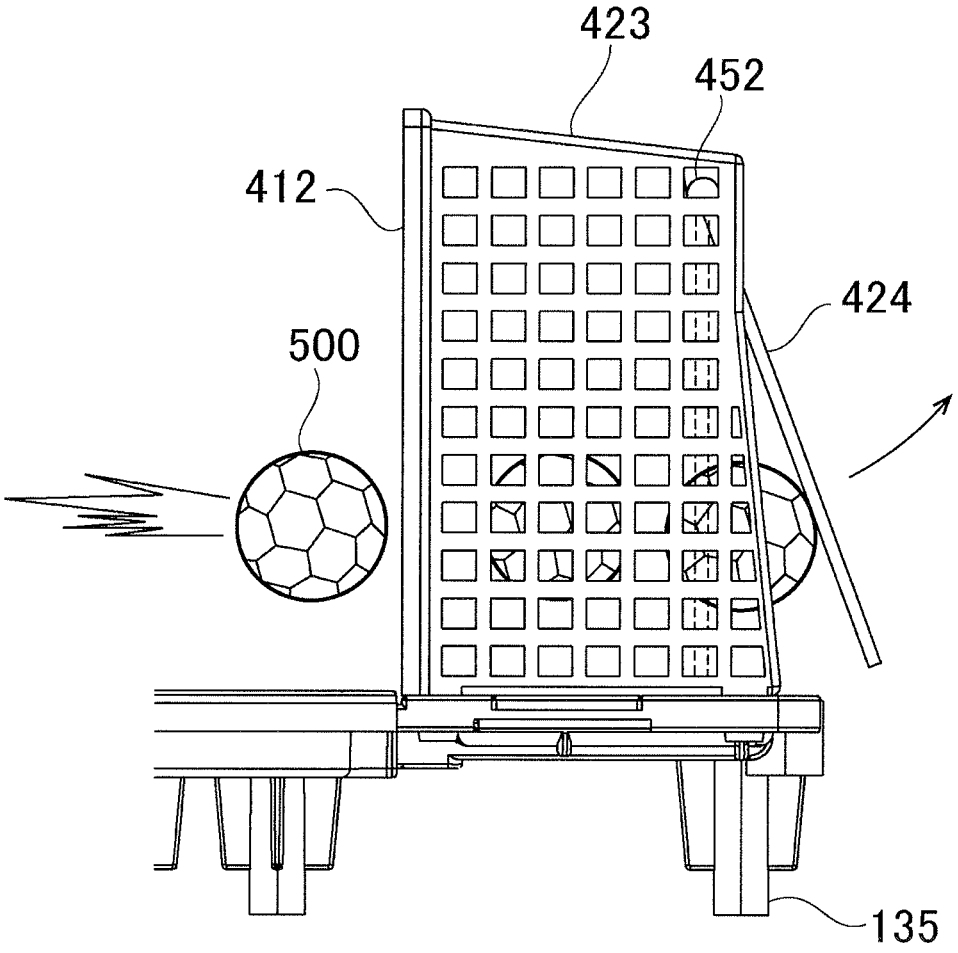
FIG. 17 is a schematic diagram illustrating how the back portion of a goal net portion of the goal member works when a ball hits it.

FIG. 17 is a schematic diagram illustrating how the back portion 424 of the goal net portion 420 of one of the goal members 400 works when a ball 500 hits it. As shown in FIG. 17, when a shot ball 500 goes into the goal member 400 at high speed and hits the front surface of the back portion 424, the back portion 424 can rotate rearward about the rotary shaft portion 450.

Figure 18:
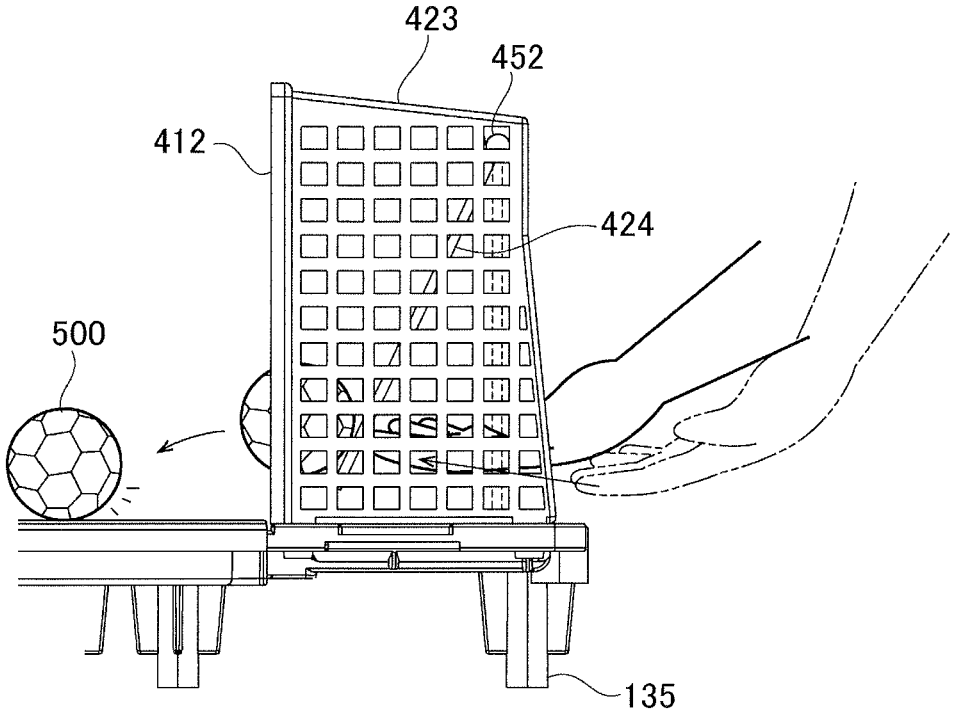
FIG. 18 is a schematic diagram illustrating how to take out a ball located inside a goal area portion.

FIG. 18 is a schematic diagram illustrating how to take out a ball 500 located inside the goal area portion 123. As shown in FIG. 18, when the user pushes the rear surface of the back portion 424 toward the field with his or her hand, the back portion 424 rotates forward about the rotary shaft portion 450. When a ball 500 is located in the goal area portion 123, the back portion 424 comes into contact with the ball 500 and pushes it to the field.

With the above structures, when a ball 500 flies into the goal member 400 and hits the front surface of the back portion 424 of the goal net portion 420, the back portion 424 can rotate rearward. By virtue of the rearward rotation of the back portion 424, the ball 500 that has hit the front surface of the back portion 424 is not likely to rebound to the area in front of the goal member 400, that is, likely settles inside the goal area portion 123 where the goal member 400 is set.

As such, the above structures make it possible to provide a game board that allows users to recognize scoring of a goal.

With the above structures, a ball 500 located in the goal area portion 123 can be retrieved easily with a hand of the user by rotating the back portion 424 forward with his or her hand.

With the above structures, since the gap S1 is secured which allows the back portion 424 to rotate rearward away from the goal member 400, a ball 500 is not likely to rebound to the area in front of the goal member 400 after hitting the front surface of the back portion 424, that is, likely settles inside the goal area portion 123 where the goal member 400 is set.

As described above, the embodiment of the invention can provide game machines of the following modes:

A first aspect provides a game board including: a field plate; a rod-shaped manipulation lever disposed under the field plate; and a player figure which is disposed above the field plate and make a play on a ball located on the field plate, wherein the field plate has a long through-hole, wherein the player figure is attached to the manipulation lever through the through-hole, wherein the player figure is movable above the field plate as the manipulation lever is moved in its axial direction, and is rotatable about a pivot portion of the player figure by a rotation manipulation on the manipulation lever, wherein the field plate has, beside the through-hole, a ball holding portion to allow the ball to stay, and wherein part of the player figure is capable of coming into contact with the ball staying in the ball holding portion.

In this configuration, the ball can stay in one of the ball holding portion which is formed beside the through-hole. The ball holding portion in which the ball may stay is formed beside the through-hole along which a player figure is to be moved rather than shares the same axis as the latter. As a result, the user can bring a portion of a player figure into contact with the ball at any of various angles and thereby move the ball to any of various directions by rotating the manipulation lever while adjusting the distance between its portion to come into contact with the ball recognizing the distance visually.

As such, the above configuration makes it possible to provide a game board capable of increasing the degree of freedom of the direction in which a ball can be moved.

In a game board of a second aspect, the ball holding portion extends long and the ball holding portion has a recess that is wider than the ball holding portion.

With this structure, the ball may in a recess rather than a ball holding portion. When the ball stays in a recess, it is stopped stably and hence the user can easily move the ball in any of various directions.

In a game board of a third aspect, the recess has a guide that projects from a portion of the outer circumference of the recess in a prescribed direction thereby guides a direction of the ball when the ball goes out of the recess.

With this structure, when the ball is moved by a player figure from a recess, the guide can guide the ball toward the goal or in a centering direction. This increases the variety of game tactics and room to reflect the tastes of a user.

In a game board of a fourth aspect, the ball holding portion extends long and branches off to extend through the field plate.

With this structure, the direction in which a player figure moves the ball located in a ball holding portion can be guided so as to be directed to, for example, a corner or the goal. This increases the variety of game tactics and room to reflect the tastes of a user.

In a game board of a fifth aspect, the ball holding portion has a plurality of long grooves formed in the field plate, and the field plate has a crossing groove which connects a first groove and a second groove of the grooves and crosses the through-hole.

With this structure, a player figure can move the ball from the first groove to the second groove via the crossing groove. This increases the variety of game tactics and room to reflect the tastes of a user.

In a game board of a sixth aspect, a lateral width of the groove is greater than that of the through-hole.

With this structure, the ball tends to stay more often in a long groove which is formed beside the associated through-hole along which a player figure is to move than in the through-hole. Thus, the user can move the ball easily in any of various directions using a long groove. This increases the variety of game tactics and room to reflect the tastes of a user.

The invention is not limited the above embodiment, and various modifications, improvements, etc. can be made as appropriate. And the material, shape, dimensions, related numerical values, form of implementation, number (where plural ones are provided), location, etc. of each constituent element of the embodiment are optional and no limitations are imposed on them as long as the invention can be implemented.

Although the embodiment is directed to the game board that enables a simulated soccer game, the invention can also be applied to game boards that enable games of other sports such as hockey.

Although the embodiment employs, as the player figures 160, stereoscopic figures that simulate soccer players, the invention may employ models that simulate characters appearing in a comic book or animals or even two-dimensional figures.

Although the embodiment employs the long grooves 140 as example ball holding portions, the invention is not limited to this case. For example, each ball holding portion may consist of short grooves, circular recesses, or through-holes arranged in succession on a single line.

Although in the embodiment the field plate 120 is formed with the two corner holes 157, the invention is not limited to this case. For example, holes for ball launching mechanisms may be formed at various positions on the field plate 120.

Although in the embodiment a simulated action of an overhead bicycle shot is realized by rotating a player figure body 310 vertically utilizing a repulsive force acting between the magnets 600 and 601, the invention is not limited to this case. For example, a small projection may be provided on the field plate 120 at such a position as to come into contact with the right foot 316 of the player figure body 310. The user can cause the player figure body 310 to rotate vertically by bringing its right foot 316 into contact with the small projection by advancing the player figure 300 whose back faces the opponent's goal.

Although in the embodiment the left end portion 451 and the right end portion 452 of the rotary shaft portion 450 are supported rotatably by the left bearing portion 440 and the right bearing portion 441, respectively, the invention is not limited to this case. An alternative structure is possible in which two side surfaces of a back portion of a goal net portion are provided with rotary shaft portions and supported by bearing portions provided on the two side portions of the goal net portion so that the back portion vertically open. Another alternative structure is possible in which a rotary shaft portion bridges the left bearing portion 440 and the right beating portion 441 and the back portion 424 is provided with bearing portions that are supported by the rotary shaft portion.

<Modification of Launching Mechanisms 201>

Figure 19A:
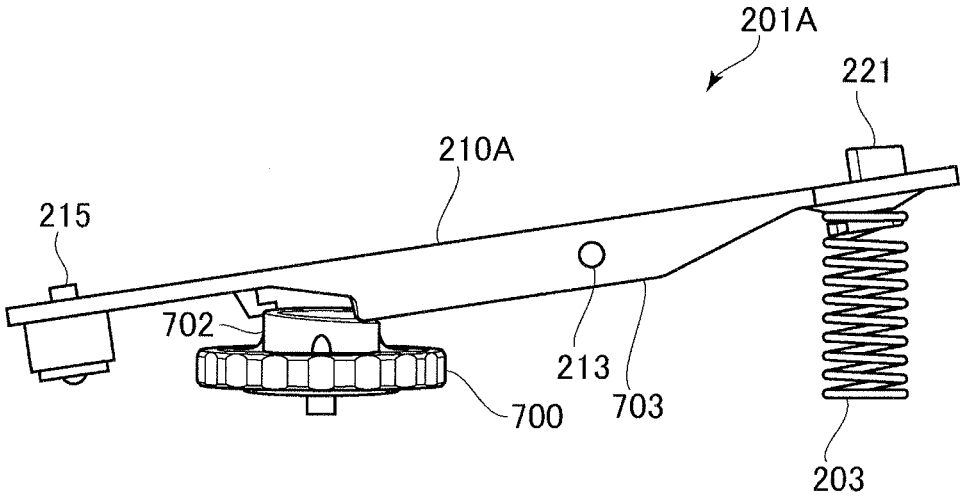
FIG. 19A is a side view of a launching mechanism according to a modification and FIG. 19B is an enlarged view of part of the launching mechanism according to the modification.
Figure 19B:
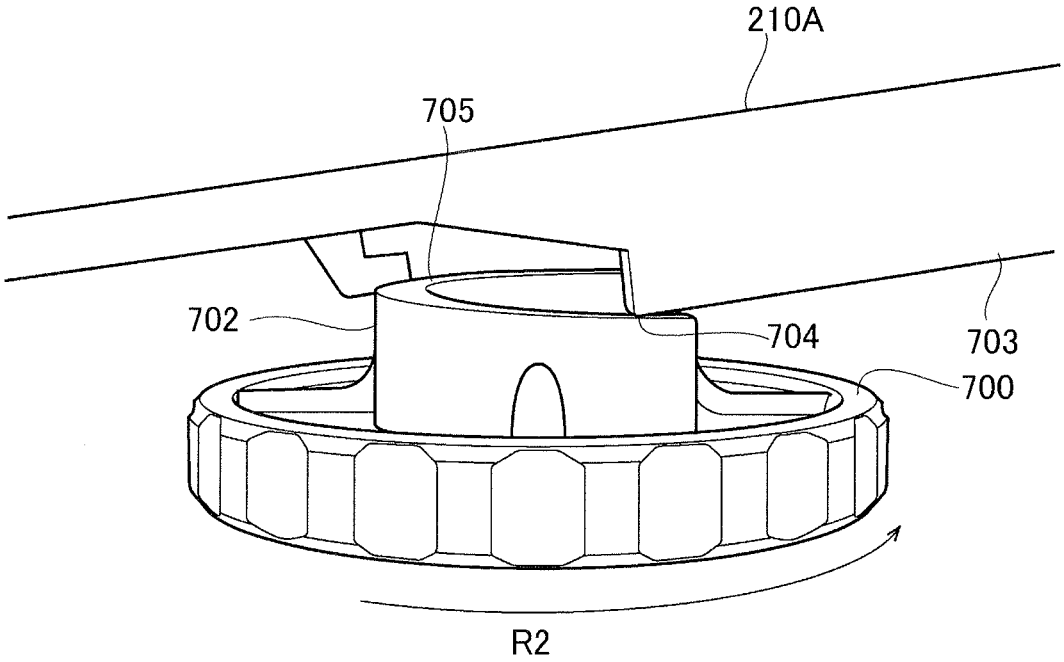

FIGS. 19A and 19B show a modification of each launching mechanism 201. FIG. 19A is a side view of a launching mechanism 201A according to the modification and FIG. 19B is an enlarged view of part of the launching mechanism 201A according to the modification.

The launching mechanism 201A is different from the launching mechanisms 201 in that the former has a circular flat dial 700 and that a left end portion 704 of a bottom edge 703 of a launching member 210A is approximately right-angled. The flat dial 700 has a certain thickness and its side circumferential surface is a continuous surface that is formed with projections and recesses alternately. A tubular portion 702 is formed on the top surface of the flat dial 700 at the center. The top surface of the tubular portion 702 is a slant surface 705 which is inclined so as to increase in height as the position goes along an arc clockwise (when seen from above).

The left end portion 704 is in line contact with the slant surface 705. When the user rotates the flat dial 700 counterclockwise (indicated by symbol R2 in FIG. 19B; when seen from above), the tubular portion 702 is also rotated counterclockwise. As a result, the height of the position of the slant surface 705 where the left end portion 704 is in contact with the slant surface 705 increases gradually and the left end portion 704 is elevated accordingly. Thus, whereas the portion of the launching member 210A that is located on the left of the rotary shafts 213 is elevated, the portion (including the projection 221) of the launching member 210A that is located on the right of the rotary shafts 213 is lowered, whereby the projection height of the projection 221 through the through-hole 159 is decreased.

With the above structures, for example, by lowering the portion of the launching member 210A that is located on the right of the rotary shafts 213 by manipulating the flat dial 700, the user can cause the elastic member 203 to assume a more contracted standby posture before launching by the launching mechanism 201A and decrease the projection height of the projection 221 through the through-hole 159. Capable of adjusting the contraction length of the elastic member 203 before launching by the launching mechanism 201A and the projection height of the projection 221 through the through-holes 159, the user can adjust the flying distance of a ball 500 launched by the launching mechanism 201A.

The invention claimed is:

1. A game board comprising:

a field plate;

a rod-shaped manipulation lever disposed under the field plate; and a player figure, which is disposed above the field plate, and configured to make contact with a ball located on the field plate, wherein the field plate has a long through-hole, wherein the player figure is attached to the rod-shaped manipulation lever through the long through-hole, wherein the player figure is movable above the field plate as the rod-shaped manipulation lever is moved in its axial direction, and is rotatable about a pivot portion of the player figure by a rotation manipulation on the rod-shaped manipulation lever, wherein the field plate has, beside the long through-hole, a ball holding portion configured to retain the ball in the ball holding portion, wherein a part of the player figure is capable of coming into contact with the ball in the ball holding portion, wherein the ball holding portion extends long, and wherein a recess configured to hold the ball therein, the recess is wider than the ball holding portion and is formed in the ball holding portion.

2. The game board according to claim 1, wherein the recess has a guide that projects from a portion of an outer circumference of the recess in a predetermined direction that guides a direction of the ball when the ball leaves the recess.

3. The game board according to claim 1, wherein the ball holding portion branches off to extend through the field plate.

4. The game board according to claim 1, wherein the ball holding portion has a plurality of long grooves formed in the field plate, wherein the field plate has a crossing groove which connects a first groove and a second groove of the plurality of long grooves, and wherein the crossing grove crosses the long through-hole.

5. The game board according to claim 4, wherein a lateral width of at least of one the plurality of long grooves is greater than that of the long through-hole.

* * * * *